US012312813B2

(12) United States Patent
Bonner

(10) Patent No.: US 12,312,813 B2
(45) Date of Patent: May 27, 2025

(54) WHEELCHAIR RAMPS, HAND RAILINGS, AND MODULAR ACCESSIBILITY SYSTEMS INCORPORATING THE SAME

(71) Applicant: Redispan Ramps, Bayshore, NY (US)

(72) Inventor: Mark Bonner, Frenchtown, NJ (US)

( * ) Notice: Subject to any disclaimer, the term of this patent is extended or adjusted under 35 U.S.C. 154(b) by 0 days.

(21) Appl. No.: 18/470,098

(22) Filed: Sep. 19, 2023

(65) Prior Publication Data

US 2024/0003138 A1 Jan. 4, 2024

Related U.S. Application Data

(63) Continuation of application No. 16/481,425, filed as application No. PCT/US2018/015497 on Jan. 26, 2018, now Pat. No. 11,788,299.

(60) Provisional application No. 62/450,588, filed on Jan. 26, 2017, provisional application No. 62/450,590, filed on Jan. 26, 2017.

(51) Int. Cl.
*E04F 11/00* (2006.01)
*E04F 11/18* (2006.01)

(52) U.S. Cl.
CPC ..... *E04F 11/002* (2013.01); *E04F 11/1817* (2013.01); *E04F 11/1865* (2013.01); *E04F 2011/007* (2013.01)

(58) Field of Classification Search
CPC . E04F 11/002; E04F 11/1817; E04F 11/1865; E04F 2011/007
USPC ..... 404/6, 9; 256/13.1, 69; 14/69.5
See application file for complete search history.

(56) References Cited

U.S. PATENT DOCUMENTS 118,156 A * 8/1871 Rohrer ..... E04H 17/1439 256/22
656,314 A * 8/1900 Beerbower ..... G05G 7/12 403/DIG. 8
3,233,871 A * 2/1966 Schroer ..... F16B 7/0446 D25/44
3,489,392 A * 1/1970 Thom ..... E04F 11/181 403/339
3,555,762 A 1/1971 Joseph, Jr.
4,014,520 A * 3/1977 Walters ..... E04F 11/1817 256/22
4,067,547 A * 1/1978 Peters ..... E04H 17/1447 256/25

(Continued)

FOREIGN PATENT DOCUMENTS

EP 3647511 A1 5/2020
GB 2362630 A 11/2001

OTHER PUBLICATIONS

International Search Report and Written Opinion issued in corrsponding International Application No. PCT/US2018/015497 dated Apr. 12, 2018, 8 pages.

(Continued)

*Primary Examiner* — Raymond W Addie
(74) *Attorney, Agent, or Firm* — Carter, DeLuca & Farrell LLP

(57) ABSTRACT

A modular system includes a post and first and second rail segments. Each of the first and second rail segments includes a tube defining a substantially hollow interior with an internal surface and an external surface and a web connected to the internal surfaces of the tube and extending across the hollow interior thereof. The web includes at least one screw boss configured for receipt of a fastener to enable engagement of the rail segment with the post.

21 Claims, 28 Drawing Sheets

(56) References Cited

U.S. PATENT DOCUMENTS 4,369,953 A * 1/1983 Greiner ..... E04H 17/143 256/73
4,577,449 A 3/1986 Celli
4,807,317 A 2/1989 Quinn et al.
4,920,596 A 5/1990 Stevens
5,058,347 A 10/1991 Schuelke et al.
5,255,897 A * 10/1993 Pepper ..... E04H 17/1447 256/66
5,347,672 A 9/1994 Everard et al.
5,566,926 A * 10/1996 Voigt ..... E01F 15/0461 256/70
5,740,575 A 4/1998 Gordon
5,971,365 A * 10/1999 Pigott ..... E04H 17/143 256/66
6,526,614 B2 3/2003 Anderson et al.
6,543,751 B1 * 4/2003 Spruill ..... E04H 17/1413 403/384
8,397,329 B2 3/2013 Just et al.
8,695,140 B1 4/2014 Zyadet
8,813,289 B1 8/2014 Clark et al.
8,914,932 B2 12/2014 Romanak et al.
8,959,693 B2 2/2015 Pohlman et al.
9,534,394 B1 1/2017 Mettler et al.
9,803,381 B1 10/2017 Bailie
11,021,350 B2 6/2021 Belton
11,788,299 B2 10/2023 Bonner
2002/0144364 A1 10/2002 Anderson et al.
2004/0056241 A1 * 3/2004 Calverley ..... E04F 11/1814 256/65.02
2006/0156492 A1 7/2006 Warford
2008/0263790 A1 10/2008 Hoffman
2009/0188035 A1 7/2009 Luxton et al.
2013/0198978 A1 8/2013 Pohlman et al.
2014/0150188 A1 6/2014 Allen
2015/0117936 A1 4/2015 Hart et al.
2018/0118477 A1 5/2018 Deshpande et al.
2019/0119922 A1 4/2019 Winter
2019/0283986 A1 9/2019 Morrish et al.

OTHER PUBLICATIONS

International Preliminary Report on Patentability issued in corresponding International Application No. PCT/US2018/015497 dated Aug. 8, 2019, 5 pages.

* cited by examiner

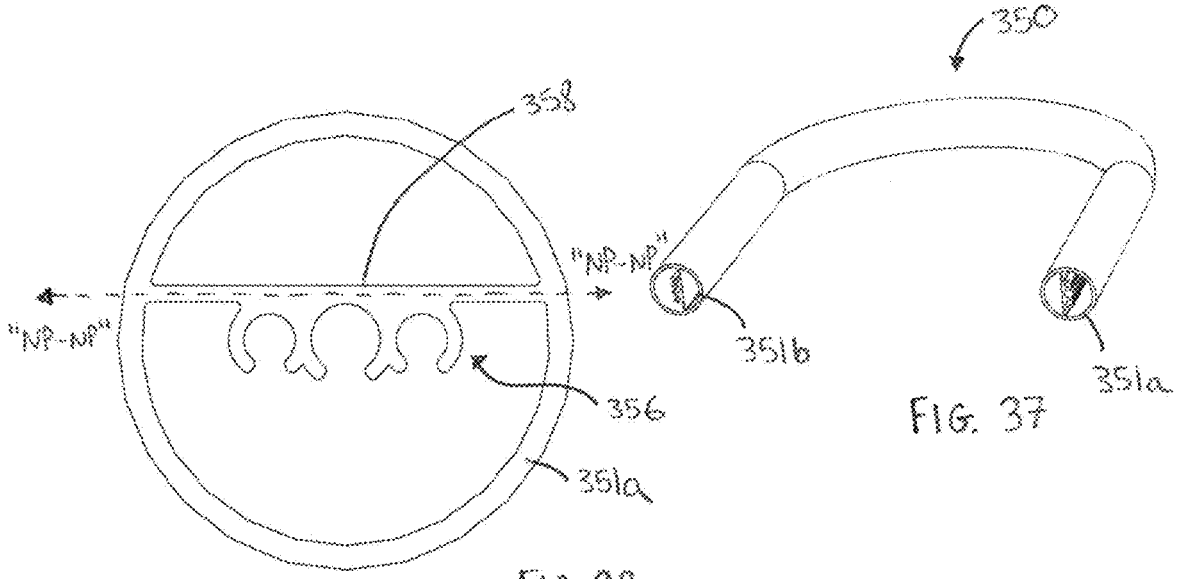
FIG. 37
FIG. 38
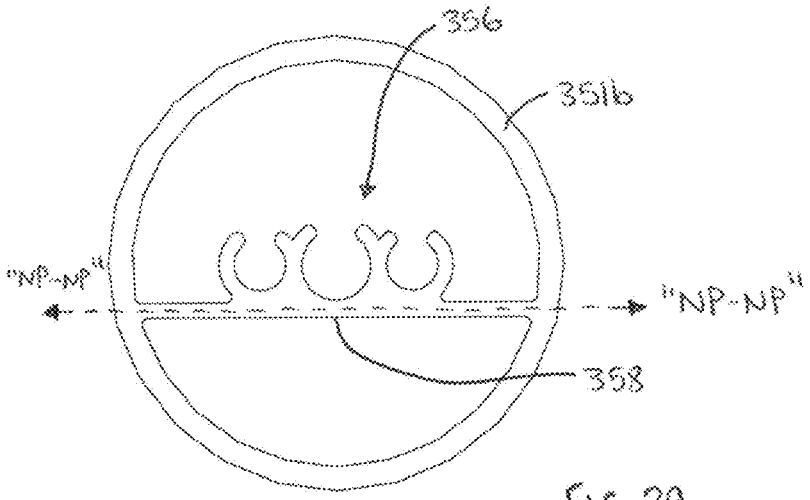
FIG. 39

WHEELCHAIR RAMPS, HAND RAILINGS, AND MODULAR ACCESSIBILITY SYSTEMS INCORPORATING THE SAME

CROSS-REFERENCE TO RELATED APPLICATIONS

This application is a continuation of U.S. patent application Ser. No. 16/481,425, filed on 26 Jul. 2019, which is a National Stage Application of International Application No. PCT/US2018/015497, filed on 26 Jan. 2018, which claims priority to, and the benefit of, U.S. Provisional Patent Application Nos. 62/450,588 and 62/450,590, both of which were filed on 26 Jan. 2017. The entire contents of each of these applications is hereby incorporated herein by reference.

BACKGROUND

Technical Field

The present disclosure relates to accessibility systems and, more specifically, to wheelchair ramps, hand railings, and modular accessibility systems incorporating the same.

Background of Related Art

Many personal residences, commercial establishments, government buildings, public facilities, and outdoor venues include accessibility systems to accommodate individuals that utilize wheelchairs or are otherwise physically impaired. In fact, in many cases, such accessibility systems are mandated by the Americans with Disabilities Act (ADA). Some of these accessibility systems are intended for permanent or long-term use, while others are for temporary or short-term use.

Regardless of whether the accessibility systems are required for long-term or short-term use, the manufacture, transportation, and installation of such systems can be challenging. For example, the various components of an accessibility system, e.g., platforms, ramps, and hand railings, may be welded together during manufacturing to form large, heavy, bulky subassemblies, thus making the transportation of these subassemblies from the manufacturing facility to the installation site difficult and expensive. In addition, the welding process itself requires a trained technician in order to ensure safety and effectiveness of the welds.

Systems that do not utilize significant amounts of welding to form subassemblies may instead rely on a variety of joint and connection parts to secure the various components of the accessibility system, e.g., platforms, ramps, and hand railings, to one another. However, the use of such joint and connection parts may overly complicate assembly and/or result in protruding areas, gaps, and/or other disturbances between the components, which could be a safety concern as well as unsightly.

Accordingly, there is a continuing need for accessibility systems including, for example, wheelchair ramps and/or hand railings, that facilitate simplified manufacturing, transportation, and on-site installation of such systems.

SUMMARY

The present disclosure provides modular accessibility systems including, for example, wheelchair ramps and/or hand railings, that facilitate simplified manufacturing, transportation, and on-site installation of such systems. To the extent consistent, any of the aspects described herein may be used in conjunction with any of the other aspects described herein.

Provided in accordance with aspects of the present disclosure is a modular system including a first surface-defining assembly including a plurality of panels, each panel including a plate portion, a first connector disposed towards and extending along a first side of the plate portion, and a second connector disposed towards and extending along a second side of the plate portion. The first and second connectors of adjacent panels are configured to engage one another to thereby engage the plurality of panels with one another in side-by-side relation such that the plate portions cooperate to define a continuous surface of the first surface-defining assembly.

In an aspect of the present disclosure, the first surface-defining assembly is a platform assembly. Alternatively, the first surface-defining assembly is a ramp assembly.

In another aspect of the present disclosure, engagement of the first and second connectors of adjacent panels defines a screw boss for receipt of a fastener.

In another aspect of the present disclosure, first surface-defining assembly further includes at least one connector panel extending along a side of the first surface-defining assembly and engaged with the plurality of panels at ends thereof. The first surface-defining assembly may further include at least two connector panels extending along sides of the first surface-defining assembly and engaged with sides of outer-most panels of the plurality of panels. Additionally or alternatively, the surface-defining assembly further includes at least one side rail extending along a side of the surface-defining assembly and engaged with a side of an outer-most panel of the plurality of panels.

In yet another aspect of the present disclosure, the at least one connector panel and the at least one side rail are formed similarly to one another, wherein the at least one side rail is engaged with the first surface-defining assembly in an inverted orientation relative to the engagement of the at least one connector panel with the first surface-defining assembly.

In still another aspect of the present disclosure, the engagement of the first and second connectors of adjacent panels defines a screw boss for receipt of a fastener to secure the connector panel to the plurality of panels. In such aspects, receipt of the fastener within the screw boss may also secure the adjacent panels in engagement with one another.

In still yet another aspect of the present disclosure, each of the panels further includes at least one rib member extending therefrom and defining a screw boss for receipt of a fastener.

In another aspect of the present disclosure, the connector panel includes a web defining upper and lower channels, and wherein the modular system further includes at least one hanger configured for engagement within the upper and lower channels. In such aspects, a second surface-defining assembly may be engaged with the first surface-defining assembly via the connector panel and the at least one hanger.

In another aspect of the present disclosure, the connector panel further includes a plate portion disposed on the web that is configured to define a bridge surface between the first surface-defining assembly and the second surface-defining assembly.

In another aspect of the present disclosure, the first surface-defining assembly further includes a side rail extending along a side thereof and engaged with a side of an outer-most panel of the plurality of panels. The side rail may define upper and lower channels, and the modular system may further include a bracket configured for engagement within the upper and lower channels.

In yet another aspect of the present disclosure, the bracket includes flanges extending therefrom and is configured for insertion into the side rail in a first orientation and subsequent rotation to a second orientation to engage the flanges within the upper and lower channels.

In another aspect of the present disclosure, a leg and/or or a hand railing os configured for engagement within the bracket.

In still yet another aspect of the present disclosure, a corner bracket is disposed at each corner of the first surface-defining assembly. A leg may be configured for engagement within one of the corner brackets.

In another aspect of the present disclosure, a third surface-defining assembly is provided including a first connector disposed towards and extending along a first end thereof and a second connector disposed towards and extending along a second end thereof. The first or second connector of the third surface-defining assembly is configured to engage a free one of the first or second connectors of one of the panels of the surface-defining assembly to thereby engage the first surface-defining assembly and the third surface-defining assembly with one another. In such aspects, engagement of the first or second connector of the third surface-defining assembly with the free one of the first or second connectors of the first surface-defining assembly defines a screw boss, and a set screw is engaged within the screw boss to secure engagement of the first surface-defining assembly and the third surface-defining assembly with one another.

In still another aspect of the present disclosure, at least two first components are provided each including a web defining a body having a first channel disposed along an upper portion of the body and a second channel disposed along a lower portion of the body. The first and second channels are orientated towards one another and define a first height between exteriors thereof and a second height between interiors thereof. The at least two first components are operatively connected to opposing sides of the first surface-defining assembly such that the first and second channels are substantially horizontally oriented relative to the continuous surface.

In yet another aspect of the present disclosure, a bracket is configured for engagement with one of the at least two first components. The bracket includes a base having first and second flanges extending from opposite ends thereof and a frame extending from the base and defines a third height between ends of the first and second flanges greater than the second height and less than the first height. A portion of the bracket is configured for insertion into one of the at least two first components in a first orientation and is further configured for rotation relative to one of the at least two first components such that the first and second flanges are respectively received within the first and second channels to engage the bracket relative to the one of the at least two first components.

In another aspect of the present disclosure, the frame of the bracket defines a passageway therethrough for receipt of a second component.

In another aspect of the present disclosure, the bracket further includes a clamp fastener operably engaged with the frame and selectively advanceable into and withdrawable from the passageway. The second component, in aspects, is disposed within the passageway and advancement of the clamp fastener into the passageway causes the clamp fastener to operably engage the second component advancing the second component towards the one of the at least two first components. Advancement of the second component towards the one of the at least two first components causes the second component to engage the one of the at least two first components, in aspects.

In still yet another aspect of the present disclosure, at least one corner bracket is disposed adjacent at least one corner of the first surface-defining assembly. The at least one corner bracket may define a corner passageway therethrough for receipt of a second component.

Additional aspects and features of the present disclosure are provided in the following enumerated paragraphs:

A1. A modular system, comprising: a first sub-assembly, including: a first component including a first connector; a second component including a second connector, wherein the first and second connectors are configured to engage one another to engage the first and second components with one another, and wherein engagement of the first and second connectors defines a screw boss therebetween; and a fastener configured for receipt within the screw boss to secure the first and second components in engagement with one another.

A2. The modular system according to A1, wherein the first and second components are panels configured to engage one another to define a continuous surface.

A3. The modular system according to A1, wherein the first connector defines an n-shaped configuration and wherein the second connector defines a u-shaped configuration.

A4. The modular system according to A1, wherein one of the first connector or the second connector defines a tongue and the other of the first connector or the second connector defines a groove, the tongue configured for engagement within the groove upon engagement of the first and second connectors with one another.

A5. The modular system according to A1, further comprising a third component, and wherein the fastener is further configured to engage the third component to the first and second components.

A6. The modular system according to A5, wherein the third component is a side rail or a connector panel.

A7. The modular system according to A6, wherein, in a first orientation, the third component functions as a side rail and wherein, in a second orientation, the third component functions as a connector panel.

A8. The modular system according to A5, wherein the third component includes a web configured to receive a bracket or a hanger.

A9. The modular system according to A8, further comprising: a second sub-assembly, including: a fourth component including a fourth connector; a fifth component including a fifth connector, wherein the fourth and fifth connectors are configured to engage one another to engage the fourth and fifth components with one another, and wherein engagement of the fourth and fifth connectors defines a screw boss therebetween; and a second fastener configured for receipt within the screw boss to secure the fourth and fifth components in engagement with one another, wherein the second sub-assembly is configured to engage the first sub-assembly via the third component and the hanger.

A10. The modular system according to A8, further comprising a leg or a hand railing, wherein the third component and the bracket are configured to engage the leg or the hand railing to the first sub-assembly.

B1. A modular system, comprising: a first component including a web defining a body having a first channel disposed along an upper portion of the body and a second channel disposed along a lower portion of the body, the first and second channels orientated towards one another and defining a first height between exteriors thereof and a second height between interiors thereof; and a bracket configured for engagement with the first component, the bracket including a base having first and second flanges extending from opposite ends thereof, the bracket further including a frame extending from the base, wherein the bracket defines a third height between ends of the first and second flanges greater than the second height and less than the first height, wherein a portion of the bracket is configured for insertion into the first component in a first orientation and is further configured for rotation relative to the first component such that the first and second flanges are respectively received within the first and second channels to engage the bracket relative to the first component.

B2. The modular system according to B1, wherein a second orientation is offset from the first orientation by 90 degrees.

B3. The modular system according to B1, wherein the frame of the bracket defines a passageway therethrough for receipt of a second component.

B4. The modular system according to B3, wherein the bracket further includes a clamp screw operably engaged with the frame, the clamp screw selectively advanceable into and withdrawable from the passageway.

B5. The modular system according to B3, wherein, a second orientation of the bracket, the passageway is vertically-oriented.

B6. The modular system according to B3, wherein, with the second component engaged within the passageway, advancement of the clamp screw into the passageway urges the second component towards the first component.

B7. The modular system according to B6, wherein advancement of the clamp screw into the passageway urges the second component to engage the first component.

B8. The modular system according to B3, wherein the passageway is offset between about 80 degrees and 90 degrees relative to longitudinal axes of the first and second channels.

B9. The modular system according to B 1, further comprising a surface-defining assembly, wherein the first component is operatively connected to a side of the surface-defining assembly and wherein the first and second channels are substantially parallel to a top surface defined by the surface-defining assembly.

B10. The modular system according to B9, wherein the surface-defining assembly comprises a plurality of panels, each panel including: a plate portion; a first connector disposed towards and extending along a first side of the plate portion; and a second connector disposed towards and extending along a second side of the plate portion, wherein the first and second connectors of adjacent panels are configured to engage one another to thereby engage the plurality of panels with one another in side-by-side relation such that the plate portions cooperate to define a continuous surface of the surface-defining assembly.

C1. A modular system, comprising: a first component including a web defining a body having a first channel disposed along an upper portion of the body and a second channel disposed along a lower portion of the body, the first and second channels orientated towards one another and defining a first height between exteriors thereof and a second height between interiors thereof; and a hanger configured for engagement with the first component, the hanger including a base having first and second flanges extending from opposite ends thereof, the hanger further including a saddle extending from the base, wherein the hanger defines a third height between ends of the first and second flanges greater than the second height and less than the first height, wherein the hanger is configured for insertion into the first component in a first position and is further configured for manipulation relative to the first component such that the first and second flanges are respectively received within the first and second channels to engage the hanger within the first component.

C2. The modular system according to C1, wherein manipulation of the hanger from the first position to the second position includes rotating the hanger relative to the first component.

C3. The modular system according to C1, wherein manipulation of the hanger from the first position to the second position includes tilting the hanger relative to the first component.

C4. The modular system according to C1, wherein the first and second flanges are respectively received within the first and second channels substantially simultaneously with one another.

C5. The modular system according to C1, wherein one of the first or second flanges is received within the respective first or second channel before receipt of the other of the first or second flanges within the respective first or second channel.

C6. The modular system according to C1, further comprising a surface-defining assembly, wherein the first component is operatively connected to a side of the surface-defining assembly and wherein the first and second channels are substantially parallel to a top surface defined by the surface-defining assembly.

C7. The modular system according to C6, wherein the surface-defining assembly comprises a plurality of panels, each panel including: a plate portion; a first connector disposed towards and extending along a first side of the plate portion; and a second connector disposed towards and extending along a second side of the plate portion, wherein the first and second connectors of adjacent panels are configured to engage one another to thereby engage the plurality of panels with one another in side-by-side relation such that the plate portions cooperate to define a continuous surface of the surface-defining assembly.

D1. A modular system, comprising: first and second rail segments; and a post assembly configured to engage the first and second rail segments with one another in end-to-end relation, the post assembly including: a first post component defining a first flat outwardly-facing side and a first inwardly-facing side including a first plurality of spaced-apart ribs; and a second post component defining a second flat outwardly-facing side and a second inwardly-facing side including a second plurality of spaced-apart ribs, wherein the first post component is configured to engage the first rail segment with the first flat outwardly facing side abutting an end of the first rail segment, wherein the second post component is configured to engage the second rail segment with the second flat outwardly facing side abutting an end of the second rail segment, and wherein the first and second pluralities of spaced-apart ribs are configured to engage one another in inter-fit relation to engage the first and second post components with one another, thereby engaging the first and second rail segments with one another.

D2. The modular system according to D1, wherein each of the first and second rail segments includes a web disposed within a hollow interior thereof, each web defining a screw boss, and wherein the first and second post components are configured to engage the first and second rail segments via fasteners extending through apertures defined within the respective first and second post components and into engagement within the screw bosses of the webs of the first and second rail segments.

D3. The modular system according to D2, wherein the screws are hidden from view when the first and second post components are engaged with the first and second rail segments and with one another.

D4. The modular system according to D1, wherein a portion of at least one rib of the first post component is removed to create a pocket, and wherein the first post component defines at least one aperture within the pocket, the at least one aperture extending between the first outwardly-facing side and the first inwardly-facing side.

D5. The modular system according to D1, wherein a portion of at least one rib of the second post component is removed to create a pocket, and wherein the second post component defines at least one aperture within the pocket, the at least one aperture extending between the second outwardly-facing side and the second inwardly-facing side.

D6. The modular system according to D1, further comprising a bolt configured to secure the first and second post components with one another with the first and second pluralities of spaced-apart ribs engaged with one another in inter-fit relation.

D7. The modular system according to D1, wherein at least one rib of the first plurality of fingers includes an engagement feature and wherein at least one rib of the second plurality of fingers includes a complementary engagement feature, the engagement feature and the complementary engagement feature configured to engage one another to secure the first and second post components with one another with the first and second pluralities of spaced-apart rib engaged with one another in inter-fit relation.

D8. The modular system according to D7, wherein the engagement feature and the complementary engagement feature are configured for snap-fit engagement with one another.

D9. The modular system according to D1, further comprising third and fourth rail segments extending in generally parallel orientation relative to the first and second rail segments, wherein the post assembly is configured to engage the third and fourth rail segments with one another in end-to-end relation.

D10. The modular system according to D1, wherein the first and second post components are substantially identical to one another.

D11. The modular system according to D1, wherein each of the first and second post components is formed monolithically via extrusion.

D12. The modular system according to D1, wherein each of the first and second rail segments is formed monolithically via extrusion.

E1. A modular system, comprising: a post assembly; and first and second rail segments configured to engage one another in end-to-end relation, each of the first and second rail segments including: an outer tube defining a substantially hollow interior; and a web connected to internal surfaces of the outer tube and extending across the hollow interior thereof, the web including at least one screw boss configured for receipt of a fastener to enable engagement of each of the first and second rail segments with the post assembly.

E2. The modular system according to E1, wherein the at least one screw boss is spaced-apart from the outer tube.

E3. The modular system according to E2, wherein the at least one screw boss is remote from the outer tube.

E4. The modular system according to E1, wherein each of the first and second rail segments is formed monolithically via extrusion.

E5. The modular system according to E1, wherein the web includes a plurality of screw bosses disposed in alignment with one another.

E6. The modular system according to E1, wherein the web includes a plurality of screw bosses disposed remote from the outer tube.

E7. The modular system according to E1, wherein the web includes a plurality of screw bosses disposed spaced-apart from the outer tube.

E8. The modular system according to E1, wherein the web includes a plate portion connected to the internal surfaces of the outer tube and extending across the hollow interior of the outer tube.

E9. The modular system according to E8, wherein the at least one screw boss extends from the plate portion.

E10. The modular system according to E1, wherein web is disposed on a neutral plane of the outer tube.

E11. The modular system according to E1, wherein the at least one screw boss is disposed on a centerline of the outer tube.

E12. The modular system according to E1, wherein at least one of the first or second rails segments is bent to a desired configuration.

E13. The modular system according to E1, wherein at least one of the first or second rail segments includes a feature defined on or within the outer tube thereof, the feature selected from the group consisting of: a plurality of spaced-apart apertures, a channel, and a flange.

E14. The modular system according to E13, wherein the plurality of apertures are configured for engagement of spindles therein, and wherein the channel is configured for engagement of an obstruction panel therein.

F1. A modular system, comprising: a first surface-defining assembly including a plurality of panels, each panel including: a plate portion; a first connector disposed towards and extending along a first side of the plate portion; and a second connector disposed towards and extending along a second side of the plate portion, wherein the first and second connectors of adjacent panels are configured to engage one another to thereby engage the plurality of panels with one another in side-by-side relation such that the plate portions cooperate to define a continuous surface of the surface-defining assembly.

F2. The modular system according to F1, wherein the engagement of the first and second connectors of adjacent panels defines a screw boss for receipt of a fastener.

F3. The modular system according to F1, wherein each of the panels further includes at least one rib member extending from the bottom surface and defining a screw boss for receipt of a fastener.

F4. The modular system according to F1, further comprising at least two first components each including a web defining a body having a first channel disposed along an upper portion of the body and a second channel disposed along a lower portion of the body, the first and second channels orientated towards one another and defining a first height between exteriors thereof and a second height between interiors thereof, wherein the at least two first components are operatively connected to opposing sides of the first surface-defining assembly such that the first and second channels are substantially parallel relative to the continuous surface.

F5. The modular system according to F4, further comprising at least 4 first components including a web defining a body having a first channel disposed along an upper portion of the body and a second channel disposed along a lower portion of the body, the first and second channels orientated towards one another and defining a first height between exteriors thereof and a second height between interiors thereof; and wherein the first components are operatively connected to the other opposing sides of the first surface-defining assembly wherein the first and second channels are substantially horizontal to a top of the first surface-defining assembly.

F6. The modular system according to F4 and/or F5, further configured for engagement with one of the at least two first components, the bracket including a base having first and second flanges extending from opposite ends thereof, the bracket further including a frame extending from the base, wherein the bracket defines a third height between ends of the first and second flanges greater than the second height and less than the first height, wherein a portion of the bracket is configured for insertion into one of the at least two first components in a first orientation and is further configured for rotation relative to one of the at least two first components such that the first and second flanges are respectively received within the first and second channels to engage the bracket relative to the one of the at least two first components.

F7. The modular system according to F6, wherein the frame of the bracket defines a passageway therethrough for receipt of a second component.

F8. The modular system according to F7, wherein the passageway is offset between 80 and 90 degrees relative to the first and second channel.

F9. The modular system according to F7, wherein, the passageway is vertically-oriented.

F10. The modular system according to F7, wherein the bracket further includes a clamp fastener operably engaged with the frame, the clamp fastener selectively advanceable into and withdrawable from the passageway.

F11. The modular system according to F10, further includes the second component engaged within the passageway wherein advancement of the clamp fastener into the passageway causes the clamp fastener to operably engage the second component advancing the second component towards the one of the at least two first components.

F12. The modular system according to F11, wherein advancement of the second component towards the one of the at least two first components causes the second component to engage the one of the at least two first components.

F13. The modular system according to F12, wherein the passageway is offset between 80 & 90 degrees relative to the first and second channel.

F14. The modular system according to F12, wherein, the passageway is vertically-oriented.

F15. The modular system according to F5, further comprising at least one corner bracket disposed adjacent at least one corner of the first surface-defining assembly.

F16. The modular system according to F15, wherein the corner bracket is operatively connected to at least one of the first and second channel of at least one first component via a fastener.

F17. The modular system according to F16, wherein the corner bracket defines a corner passageway therethrough for receipt of a second component.

F18. The modular system according to F17, wherein the corner bracket includes a clamp fastener operably engaged with the corner bracket, the clamp fastener selectively advanceable into and withdrawable from the corner passageway.

F19. The modular system according to F18, further includes the second component engaged within the corner passageway wherein advancement of the clamp fastener into the corner passageway causes the clamp fastener to operably engage the second component advancing the second component towards an inside surface of the corner passageway.

F20. The modular system according to F19, wherein advancement of the second component towards the inside surface of the corner passageway causes the second component to engage the corner bracket.

F21. The modular system according to F54 and/or F5, further comprising at least one hanger configured for engagement with the first component, the hanger including a base having first and second flanges extending from opposite ends thereof, the hanger further including a receiving area extending from the base, wherein the hanger defines a third height between ends of the first and second flanges greater than the second height and less than the first height, wherein a portion of the hanger is configured for insertion into the first component such that the first and second flanges are respectively received within the first and second channels to engage the hanger relative to the first component.

F22. The modular system according to F21, further comprising: a second surface-defining assembly wherein the second surface-defining assembly is in supported relation to the first surface-defining assembly via the receiving area of the hanger.

F23. The modular system according to F22, wherein the second surface-defining assembly comprises a plurality of panels, each panel including: the plate portion; the first connector disposed towards and extending along the first side of the plate portion; and the second connector disposed towards and extending along the second side of the plate portion, wherein the first and second connectors of adjacent panels are configured to engage one another to thereby engage the plurality of panels with one another in side-by-side relation such that the plate portions cooperate to define a continuous surface of the surface-defining assembly.

BRIEF DESCRIPTION OF THE DRAWINGS

Various aspects of the present disclosure are described herein with reference to the drawings wherein like reference numerals identify similar or identical elements and:

FIG. 37 is a perspective view of an end rail of the hand railing assembly;

FIGS. 38 and 39 are end views of the tube ends of the end rail;

DETAILED DESCRIPTION

Figure 1:
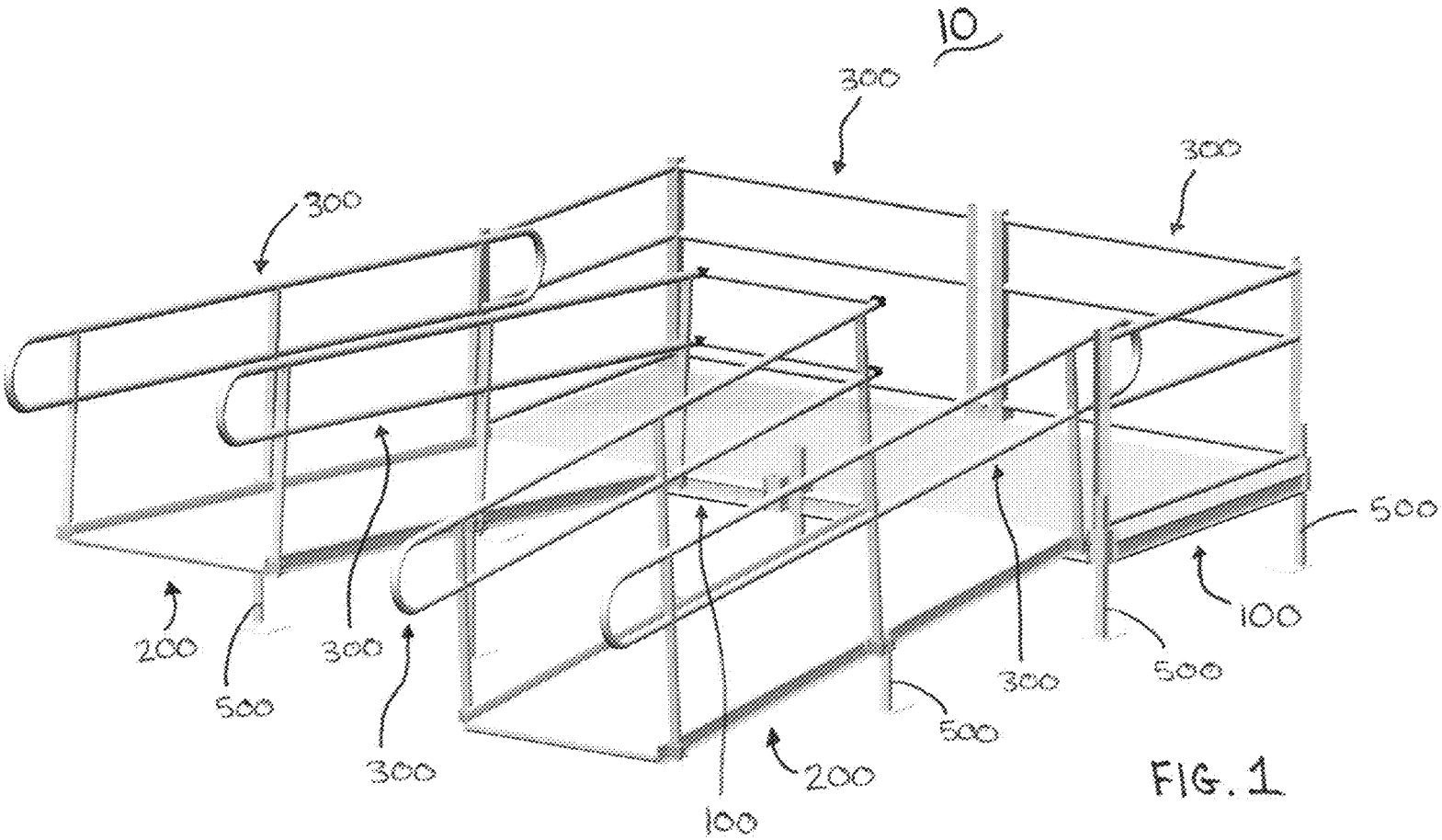
FIG. 1 is a perspective view of a modular accessibility system in accordance with the present disclosure.

Turning to FIG. 1, provided in accordance with the present disclosure is a modular accessibility system identified generally by reference numeral 10. Modular accessibility system 10 includes various aspects and features, detailed below. However, it is understood that the various aspects and features, although detailed with respect to modular accessibility system 10, need not necessarily be utilized together with one another and/or may find other application outside of modular accessibility system 10. Accordingly, modular accessibility system 10 is merely one exemplification of the aspects and features of the present disclosure.

Modular accessibility system 10 generally includes one or more platform assemblies 100, one or more ramp assemblies 200, one or more hand railing assemblies 300 supported by the platform assemblies 100 and/or ramp assemblies 200, and one or more legs 500 supporting the platform assemblies 100 and ramp assemblies 200.

Referring to FIGS. 2-4 and 6, a platform assembly 100 is described. Platform assembly 100 includes a plurality of platform panels 110 engaged with one another to define the usable, generally planar surface 102 of platform assembly 100, one or more connector panels 130 extending along sides of platform assembly 100, and a plurality of, e.g., four (4), corner brackets 150 disposed at the corners of platform assembly 100. As an alternative to one or more of the connector panels 130, platform assembly 100 may include one or more side rails (not shown, similar to side rail 270 of ramp assembly 200 (see FIG. 5)), extending along sides of platform assembly 100. As detailed below, in some configurations, connector panels 130 and the side rails may be different components or, in other configurations, may be the same component oriented differently to suite the application. For example, the connector panels 130 and side rails may be the same component wherein, for use as a connector panel 130 of platform assembly 100, the component is oriented right-side-up (see FIGS. 3 and 4) and, for use as a side rail, e.g., side rail 270 of ramp assembly 200, the component is oppositely oriented in an up-side-down orientation (see FIG. 5).

Each of the plurality of platform panels 110 may be monolithically formed as a single piece of material, e.g., via extrusion or other suitable process (although other manufacturing methods are also contemplated), defining an elongated strip-like configuration and including a plate portion 112, first and second connectors 114, 116 depending from plate portion 112 at opposing sides thereof, and one or more rib members 118 depending from plate portion 112 intermediate the opposing sides thereof. Platform panels 110 may define any suitable dimensions depending upon a particular purpose and any suitable number of platform panels 110 may be combined to define a planar surface 102 of platform assembly 100 of suitable dimensions, again depending upon a particular purpose.

The plate portion 112 of each platform panel 110 defines a generally planar configuration including an upper surface that forms part of generally planar surface 102 of platform assembly 100. More specifically, upon engagement of platform panels 110 with one another in side-by-side relation, as detailed below, plate portions 112 cooperate to define generally planar surface 102 of platform assembly 100. Each plate portion 112 may include ridges, protrusions, or other features defined on the upper surface thereof to facilitate traction on generally planar surface 102 of platform assembly 100.

First and second connectors 114, 116 extend along and depend from plate portions 112 at opposed sides thereof, as noted above. Each first connector 114 defines a generally n-shaped configuration having three sides and a downwardly-facing opening. Each second connector 116, on the other hand, defines a generally u-shaped configuration having three sides and an upwardly-facing opening. Each first connector 114 further includes a tongue 115 extending partially across the downwardly-facing opening thereof, and each second connector 116 further defines a groove 117 on the side opposite the upwardly-facing opening thereof.

The above-detailed configurations of first and second connectors 114, 116 enable engagement of the first connector 114 of a platform panel 110 with the second connector 116 of an adjacent platform panel 110 to engage the adjacent platform panels 110 with one another. More specifically, each first connector 114 is fit within the adjacent second connector 116 with the tongue 115 received within the groove 117 to engage the adjacent platform panels 110 with one another. Further, the inter-fit n-shaped and u-shaped first and second connectors 114, 116, respectively, cooperate to define a screw boss 120 of appropriate dimensions to be capable of receiving and securing therein a fastener, e.g., a screw "S," as detailed below.

Each rib member 118 of each platform panel 110 depends from the plate portion 112 thereof intermediate the opposing sides of the platform panel 110, as noted above. Each rib member 118 may define a c-shaped channel 119 of appropriate dimensions to serve as a screw boss capable of receiving and securing therein a screw "S," as detailed below.

Figure 2:
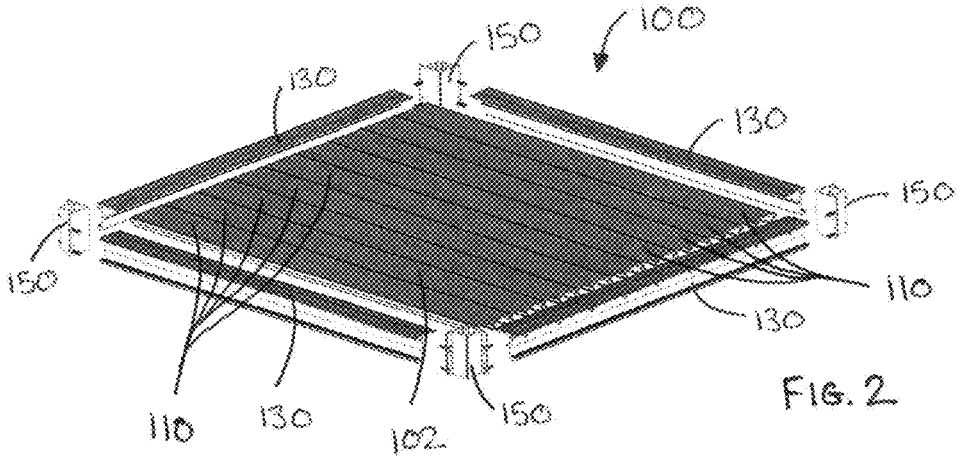
FIG. 2 is an exploded, perspective view of a platform assembly of the modular accessibility system.
Figure 3:
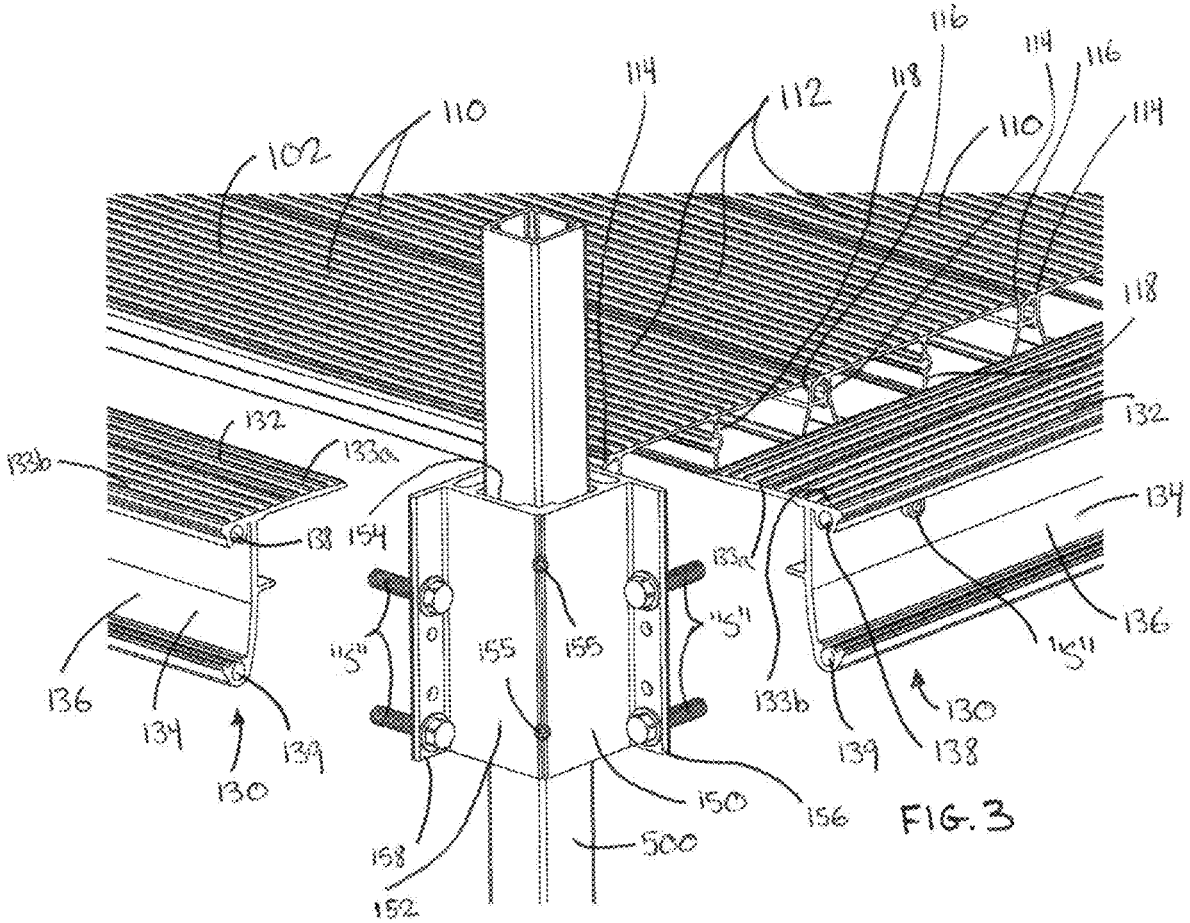
FIG. 3 is an exploded, perspective view illustrating engagement of a corner bracket, platform panels, and connector panels of the platform assembly.
Figure 4:
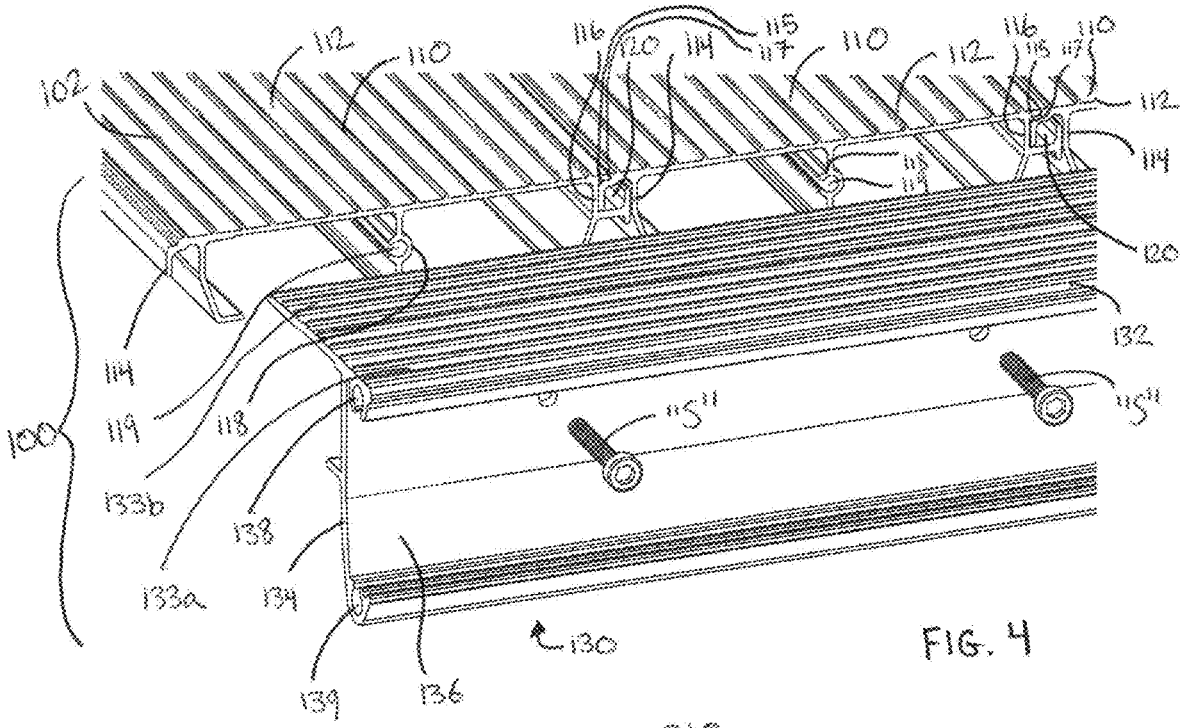
FIG. 4 is an exploded, perspective view illustrating engagement of a connector panel with platform panels of the platform assembly.

Continuing with reference to FIGS. 2-4 and, each connector panel 130 of platform assembly 100 extends along a side of platform assembly 100. Each connector panel 130 may be monolithically formed as a single piece of material defining an elongated strip-like configuration, although other configurations are also contemplated. Each connector panel 130 includes a plate portion 132 defining an elongated strip-like configuration, and a web 134 depending from an underside of plate portion 132, extending therealong, and oriented substantially perpendicularly relative to plate portion 132 so as to define a generally T-shaped configuration therewith.

The plate portion 132 defines a generally planar configuration and is configured to abut, overlay, or underlay the plate portion 112 of one or more platform panels 110 to serve as an extension of planar surface 102 of platform assembly 100 along a side thereof. The plate portion 132 may include ridges, protrusions, or other features configured to facilitate traction, similarly as with plate portions 112 of platform panels 110.

The web 134 of each connector panel 130, as noted above, depends from an underside of the plate portion 132 thereof, extends therealong, and is oriented to define a generally T-shaped configuration therewith. However, the web 134 is offset towards one side of plate portion 132 such that plate portion 132 includes a wide segment 133*a* on one side of web 134 and a narrow segment 133*b* on the other side of web 134. Web 134 includes a body 136 which may include a plurality of spaced-apart screw apertures defined therethrough and is configured to define the upright portion of the generally T-shape of web 134 and plate portion 132. Web 134 further includes an upper c-shaped channel 138 disposed at one end of body 136, depending from an underside of the narrow segment 133*b* of plate portion 132, and oriented such that the opening in the upper c-shaped channel 138 faces downwardly; and a lower c-shaped channel 139 disposed at the other end of body 136 and oriented such that the opening in the lower c-shaped channel 139 faces upwardly, opposing the opening of upper c-shaped channel 138.

As best illustrated in FIG. 4, in order to engage a connector panel 130 alongside the platform panels 110, the connector panel 130 is positioned such that wide segment 133*a* of plate portion 132 abuts, overlays, or underlays the ends of plate portions 112 of platform panels 110. Screws "S" may then be inserted through the spaced-apart screw apertures and into engagement within the c-shaped channels 119 of rib members 118 of platform panels 110 and/or the screw bosses 120 formed by the first and second connectors 114, 116 of adjacent platform panels 110 to thereby secure connector panel 130 in position extending along the sides of the platform panels 110 such that the plate portion 132 of connector panel 130 serves as an extension of planar surface 102 of platform assembly 100. With respect to engagement of fasteners, e.g., screws "S," within the screw bosses 120 formed by the first and second connectors 114, 116 of adjacent platform panels 110, not only does this secure the connector panel 130 to the platform panels 110, but the engagement of screws "S" within screw bosses 120 may also serves to lock the adjacent platform panels 110 in engagement with one another, inhibiting disengagement of the first and second connectors 114, 116 from one another.

Referring back to FIGS. 2 and 3, corner brackets 150 are disposed at the corners of platform assembly 100. Each corner bracket 150 includes a body 152 defining a vertically-oriented passageway 154 having a rectangular cross-section (although other configurations are also contemplated) and configured to receive a leg 500 to support platform assembly 100 off the ground. The leg 500 may be engaged within passageway 154 by set screws 155 extending through a corner of body 152 into passageway 154, although other positions of set screws 155 and/or other suitable mechanisms for retaining leg 500 are also contemplated. As can be appreciated, set screws 155 (or another mechanism, if so provided) may be adjustable to vary a position of leg 500, thereby varying a height of platform assembly 100 relative to the ground. Each corner bracket 150 further includes a pair of flanges 156, 158 extending therefrom and may be disposed in perpendicular orientation relative to one another. Flanges 156, 158 each define one or more screw apertures enabling fasteners, e.g., screws "S" to be inserted therethrough and into upper and lower c-shaped channels 138, 139 of connector panels 130 on either side of the corner bracket 150 to secure the connector panels 130 to one of the corner brackets 150 at each corner of platform assembly 100. As can be understood, the upper and lower c-shaped channels 138, 139 of connector panels 130 may also be configured to serve as screw bosses.

With momentary reference to FIG. 5, as noted above, as an alternative to one or more of connector panels 130, one or more side rails may be utilized along one or more sides of a platform assembly 100, similarly as detailed below and illustrated in FIG. 5 with respect to side rails 270 of platform assembly 200. Connector panels 130 may be utilized on a side of platform assembly 100, for example, where another surface-defining assembly, e.g., another platform assembly 100, a ramp assembly 200, etc. (see FIG. 1), is desired to be connected to that side of platform assembly 100. The side rails, on the other hand, may be utilized on a side of platform assembly 100 where no further surface-defining assemblies are intended to be joined but rather, only legs 500 and/or hand railing assemblies 300 are to be attached. Each side rail may be configured similarly to the connector panels 130 or, as mentioned above, these may be the same component, just oriented differently depending upon whether use as a connector panel 130 or side rail.

Figure 6:
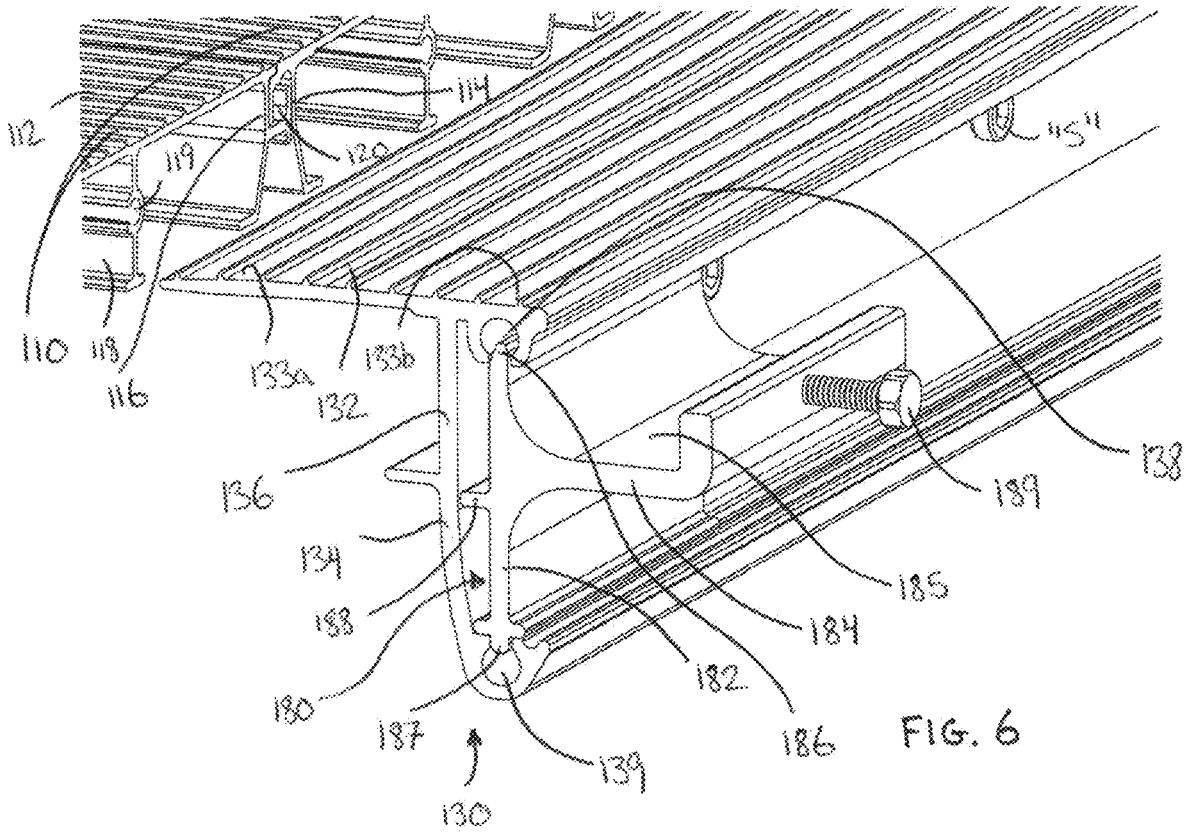
FIG. 6 is a perspective view illustrating engagement of a hanger with a connector panel of the platform assembly.

Turning to FIG. 6, as noted above, one or more hangers 180 may be operably coupled with a connector panel 130 to enable attachment of another component with platform assembly 100, for example, a ramp assembly 200 (FIGS. 7-15) (although another platform assembly 100 (FIG. 1) or other surface-defining assembly is also contemplated), with connector panel 130 serving as the bridge between the platform assembly 100 and ramp assembly 200. Each hanger 180 includes a base or back panel 182 and a saddle 184 extending from the back panel 182 genearlly perpendicularly therefrom. Back panel 182 includes an upper end defining a first flange or guide rail 186 and a lower end defining a second flange or guide rail 187. An extension 188 extends from back panel 182 in a direction opposite the direction saddle 184 extends. Saddle 184 defines a receiving area 185 and includes a clamp screw 189 that is selectively extendable into and withdrawable from receiving area 185.

In order to operably couple a hanger 180 to a connector panel 130, the hanger 180 is positioned such that first and second guide rails 186, 187 are aligned with the open ends of upper and lower c-shaped channels 138, 139, respectively, of the connector panel 130, and is slid relative thereto such that first and second guide rails 186, 187 are slidably received within upper and lower c-shaped channels 138, 139, respectively. Extension 188 of hanger 180 may ensure appropriate spacing between back panel 182 of hanger 180 and body 136 of web 134 of connector panel 130 to permit hanger 180 to slide along connector panel 130 without interference from the screw heads of screws "S." Any suitable number of hangers 180 may be operably coupled to connector panel 130 in this manner and slid to suitable positions depending upon, for example, the component to be engaged to the connector panel 130. As an alternative to the above, hanger 180 can be maneuvered into position similarly as detailed below with respect to bracket 400 (FIGS. 16-24). More specifically, hanger 180 may be oriented such that first and second guide rails 186, 187 extend vertically and, thereafter, hanger 180 may be inserted transversely into web 134 of connector panel 130 between upper and lower c-shaped channels 138, 139. Once hanger 180 is in this position, hanger 180 is rotated such that first and second guide rails 186, 187 are horizontally-oriented. As hanger 180 is rotated in this manner, first and second guide rails 18, 187 are inserted into engagement within upper and lower c-shaped channels 138, 139 to achieved the engaged configuration detailed above. In yet another alternative, first guide rail 186 is first inserted into upper c-shaped channel 138 with the remainder of hanger 180 angling outwardly from web 134 of connector panel 130. Thereafter, second guide rail 187 is maneuvered and/or web 134 manipulated such that second guide rail 187 is positioned above lower c-shaped channel 139 and dropped down into engagement within lower c-shaped channel 139. The reverse is also contemplated, e.g., wherein second guide rail 187 is first engaged within lower c-shaped channel 139 and thereafter first guide rail 186 maneuvered and/or web 134 manipulated to engage first guide rail 186 within upper c-shaped channel 138.

Figure 8:
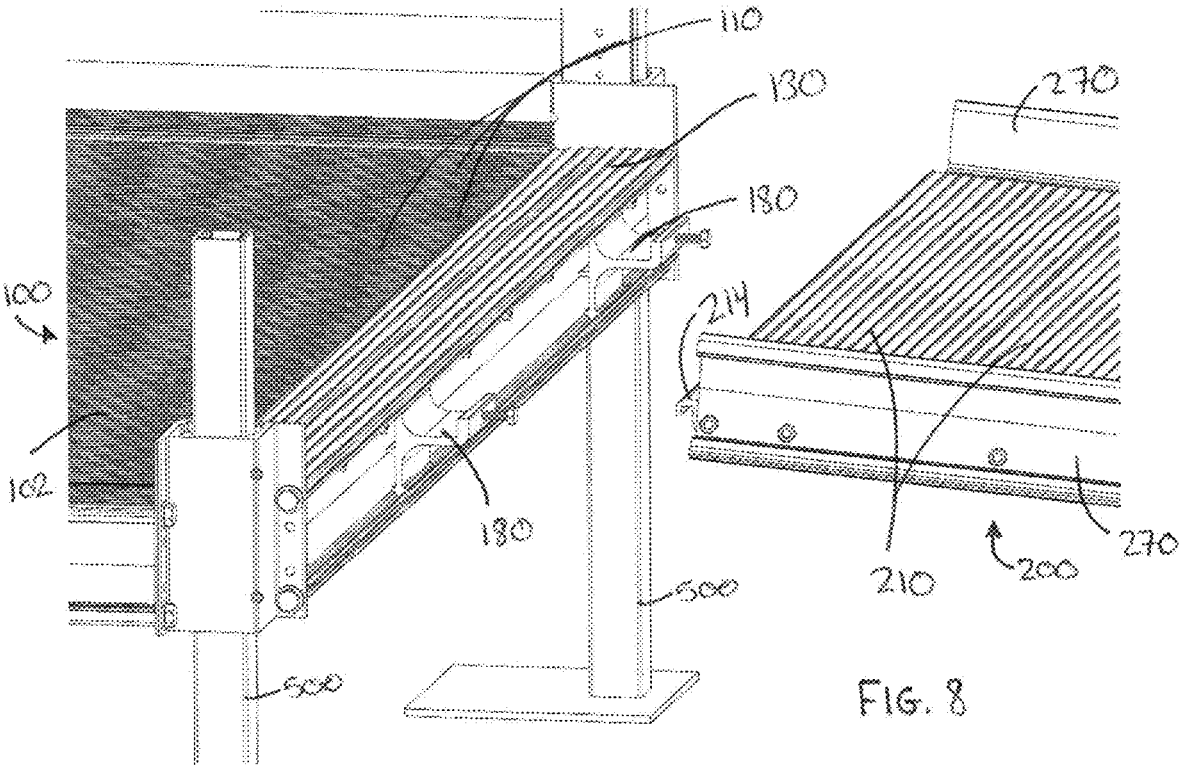
Figure 9:
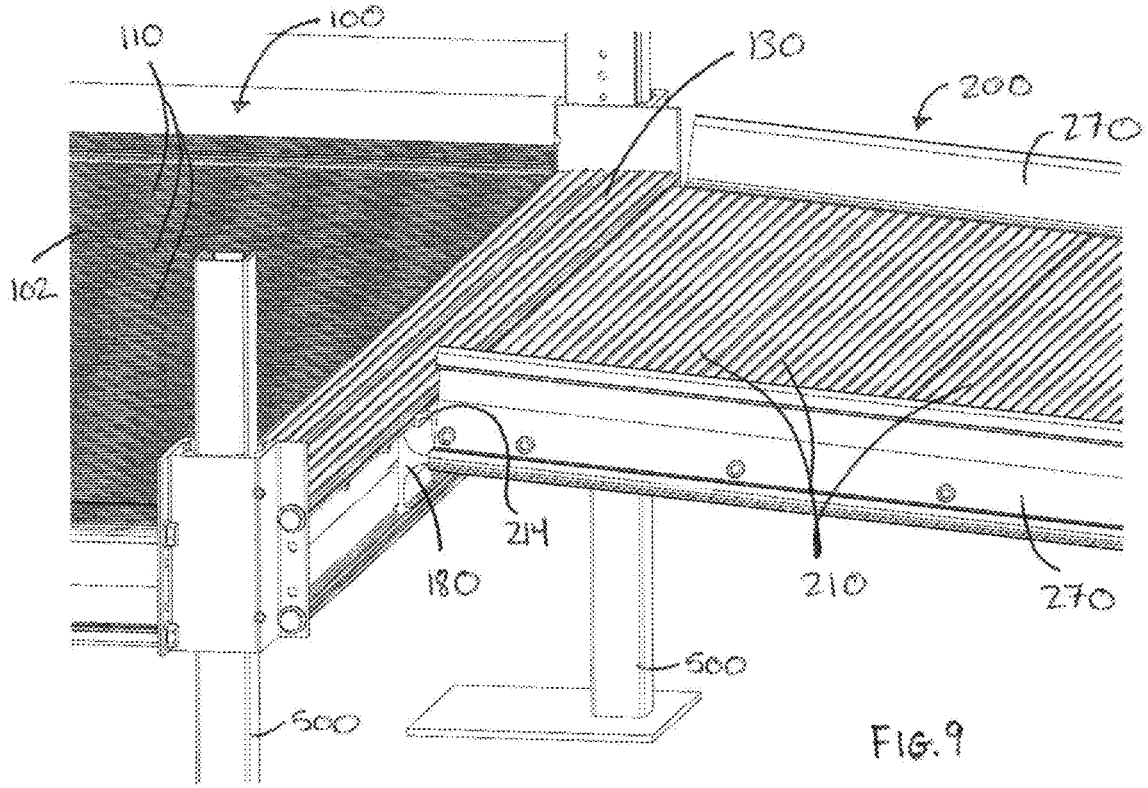
Figure 10:
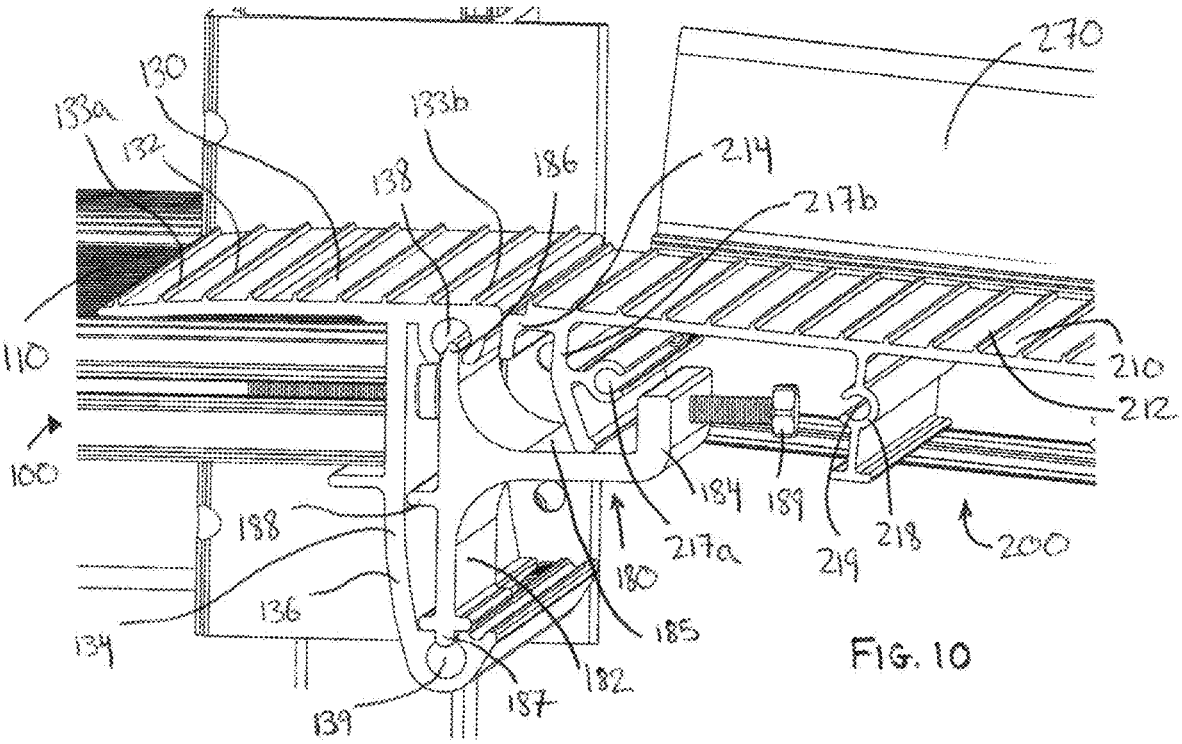
FIG. 10 is a cross-sectional view illustrating the ramp assembly engaged with the platform assembly via hangers.
Figure 11:
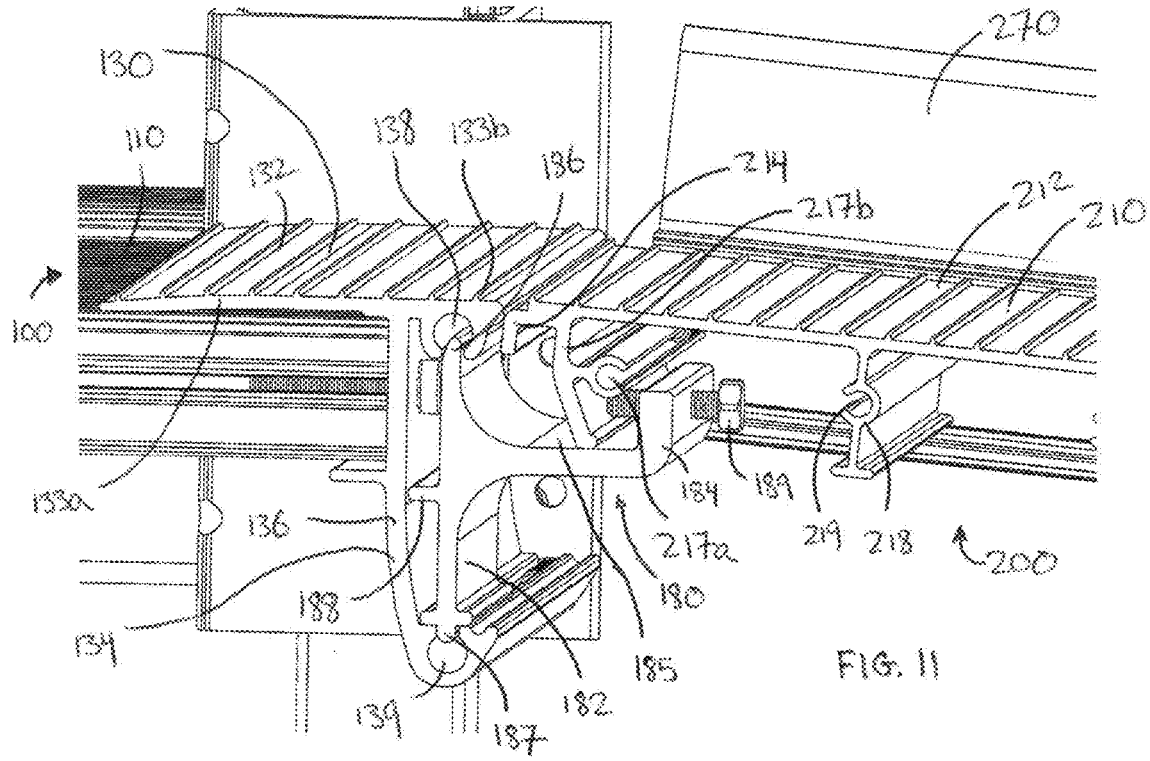
FIG. 11 is a cross-section view illustrating the ramp assembly engaged and secured with the platform assembly via hangers.
Figure 12:
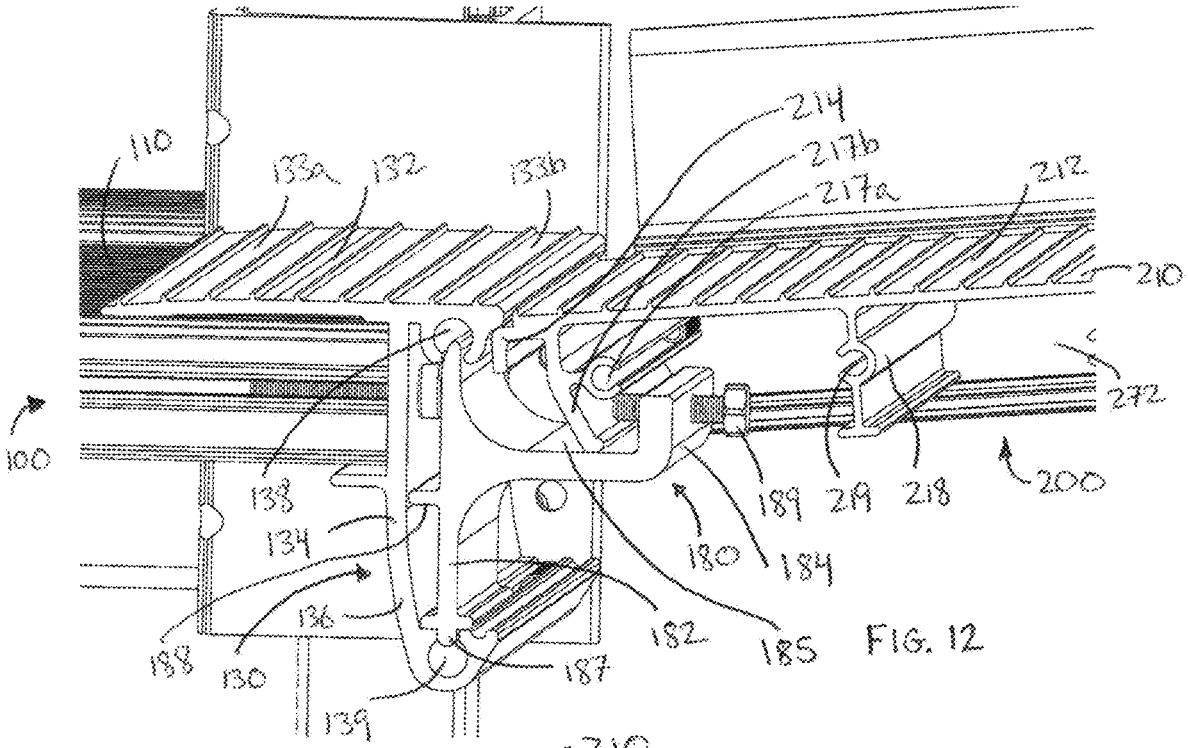
FIG. 12 is a cross-section view illustrating the ramp assembly engaged, in an alternate manner, and secured with the platform assembly via hangers.
Figure 13:
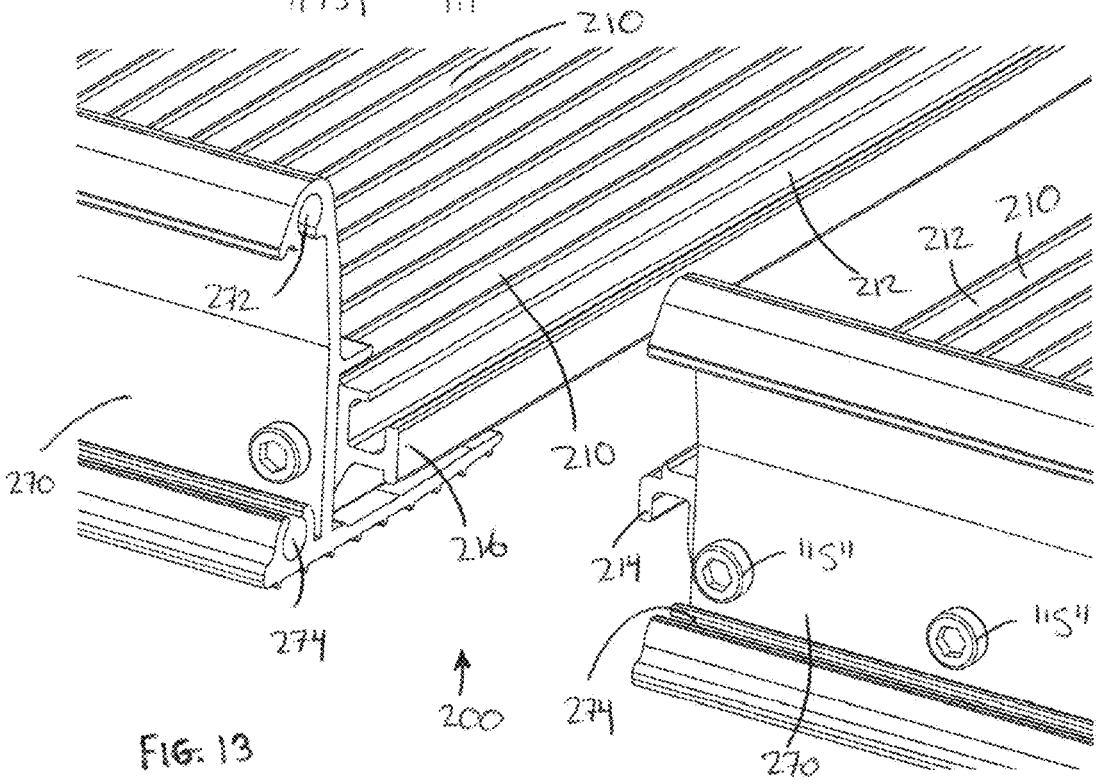
FIG. 13-15 are progressive, perspective views illustrating engagement and securement of ramp panels of the ramp assembly with one another.
Figure 14:
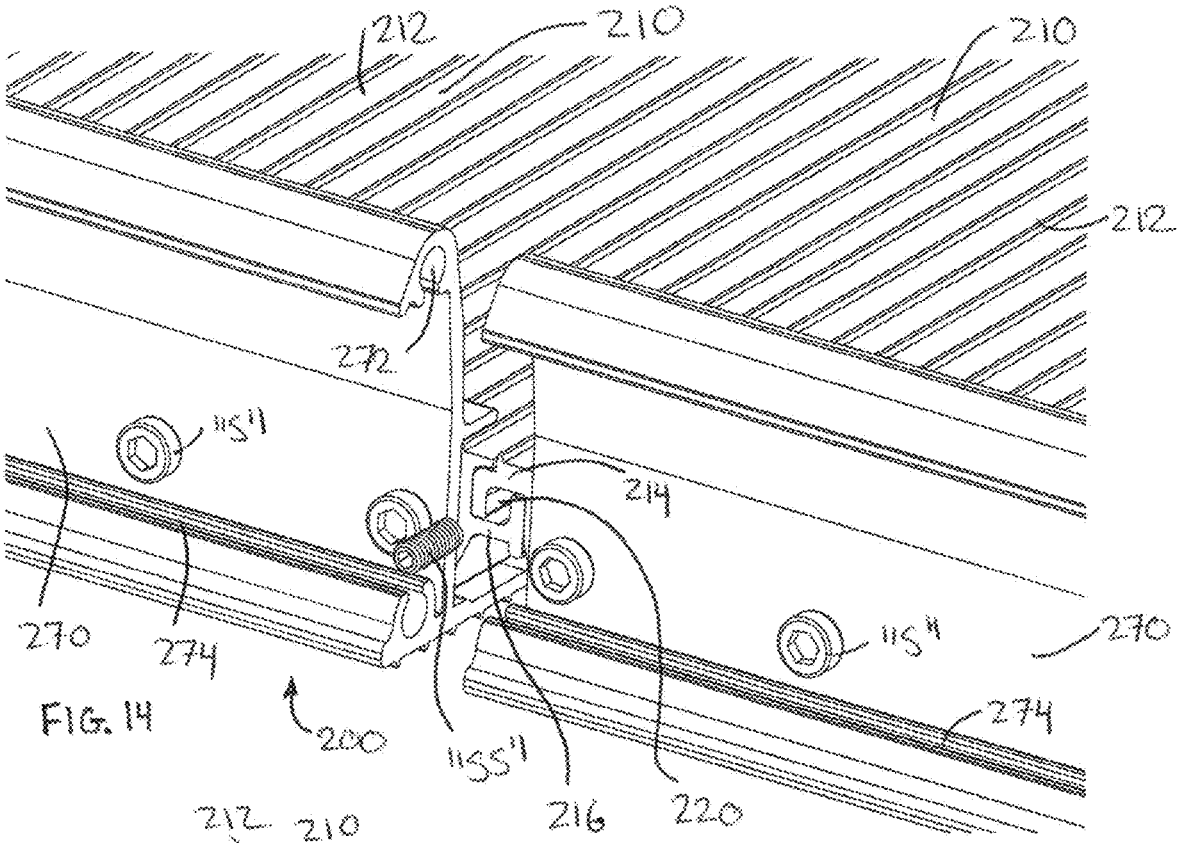
Figure 15:
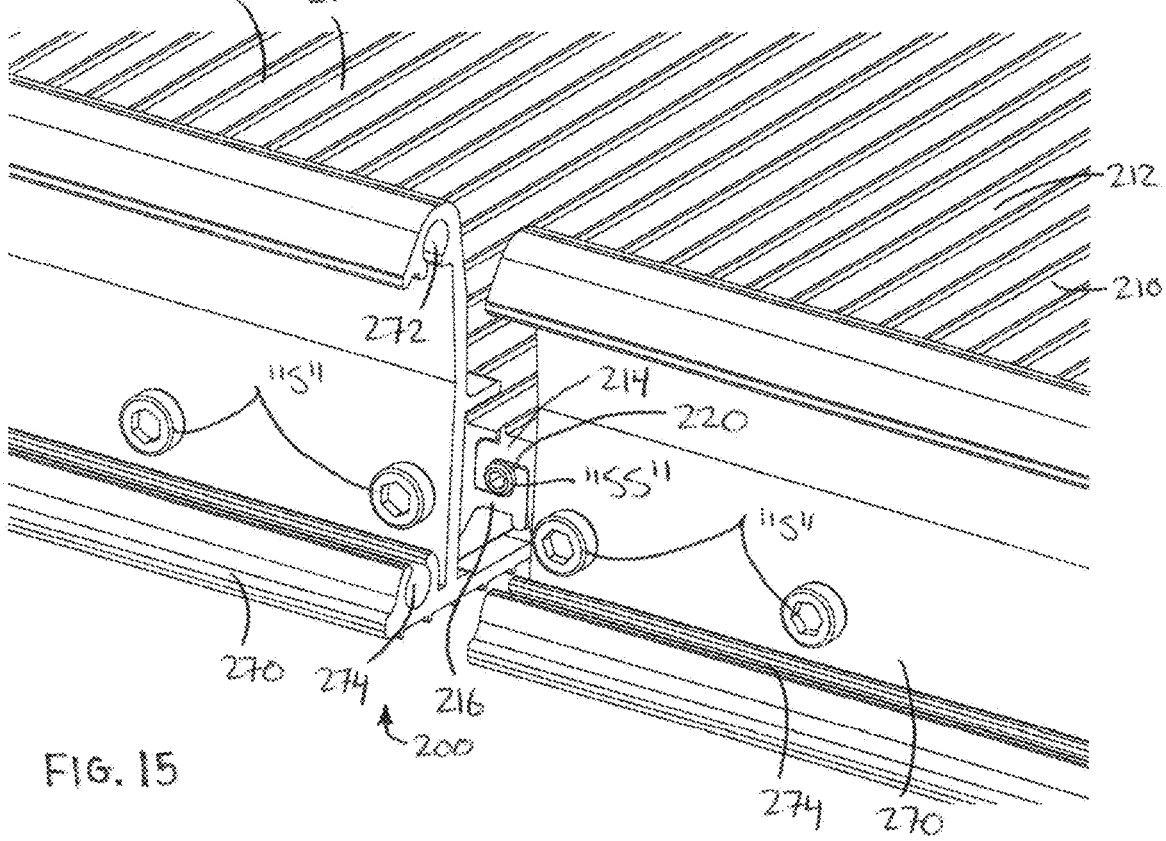
Figure 16:
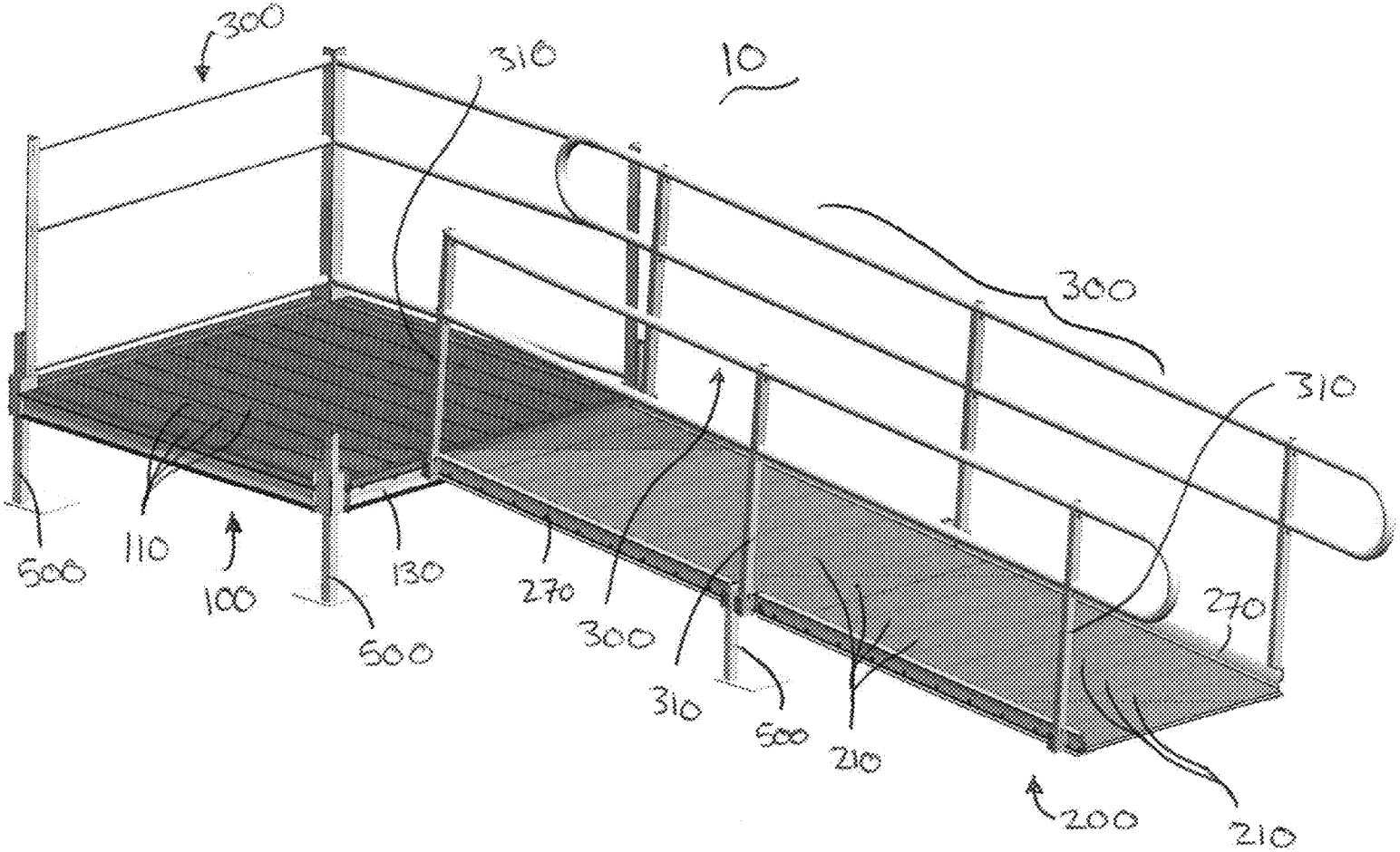
FIG. 16 is a perspective view of a portion of the modular accessibility system illustrating a leg and a hand railing assembly engaged with the ramp assembly.
Figure 17:
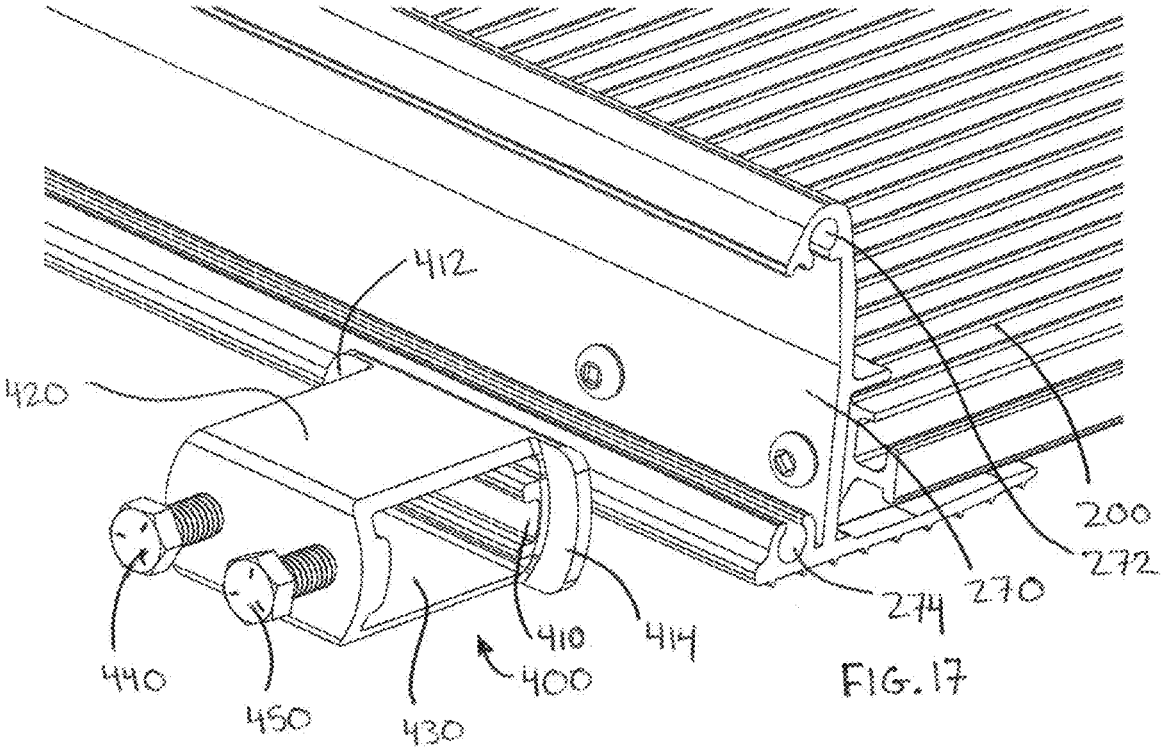
FIGS. 17-20 are progressive, perspective views illustrating engagement of a bracket with the ramp assembly.
Figure 18:
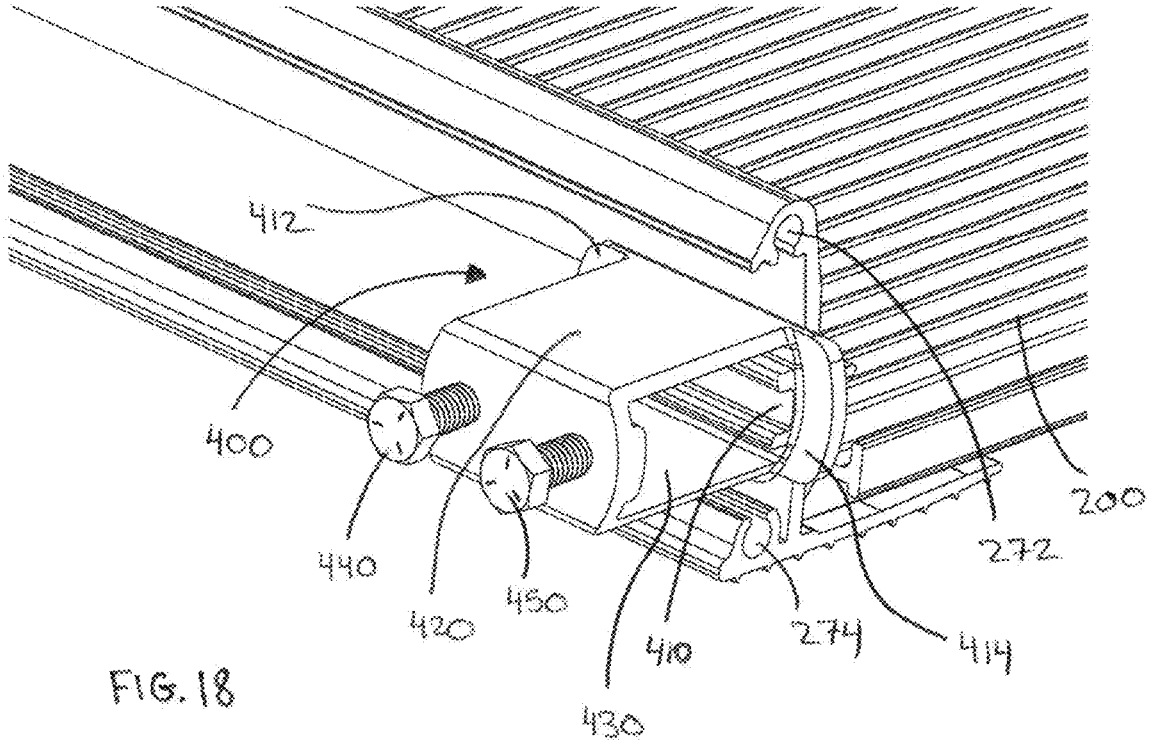
Figure 19:
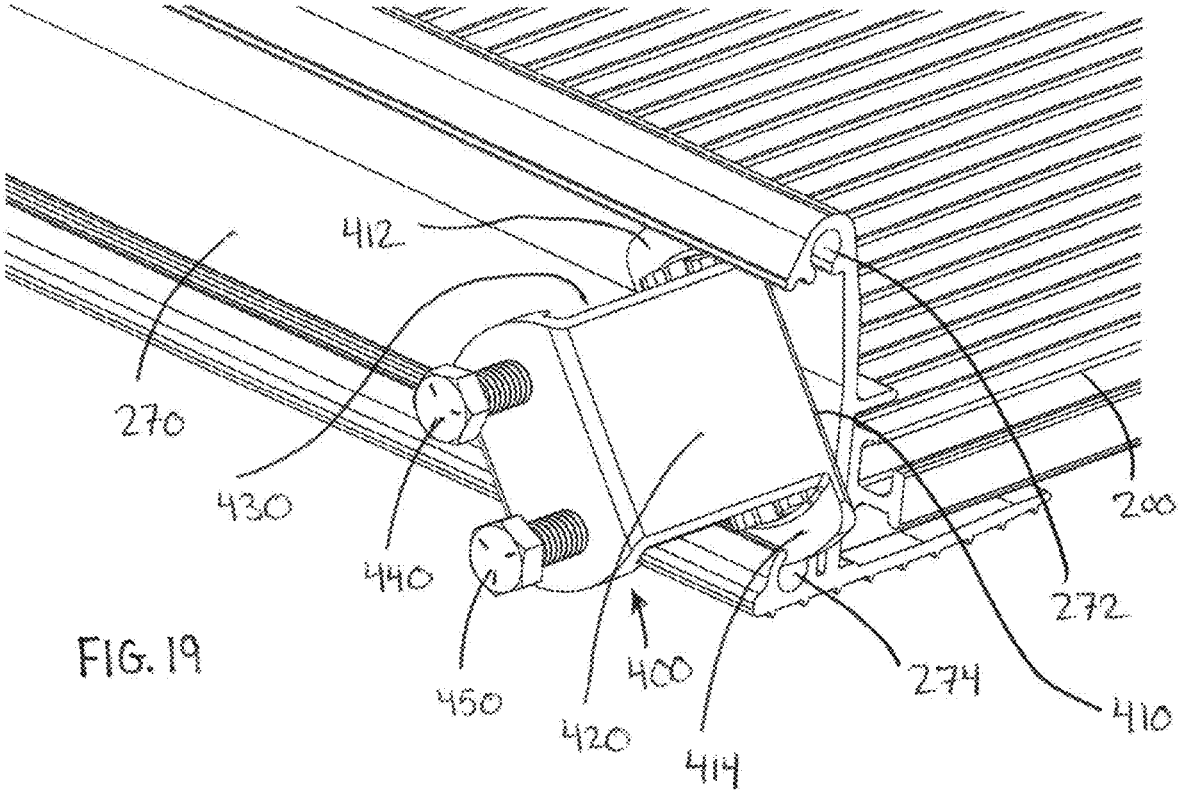
Figure 20:
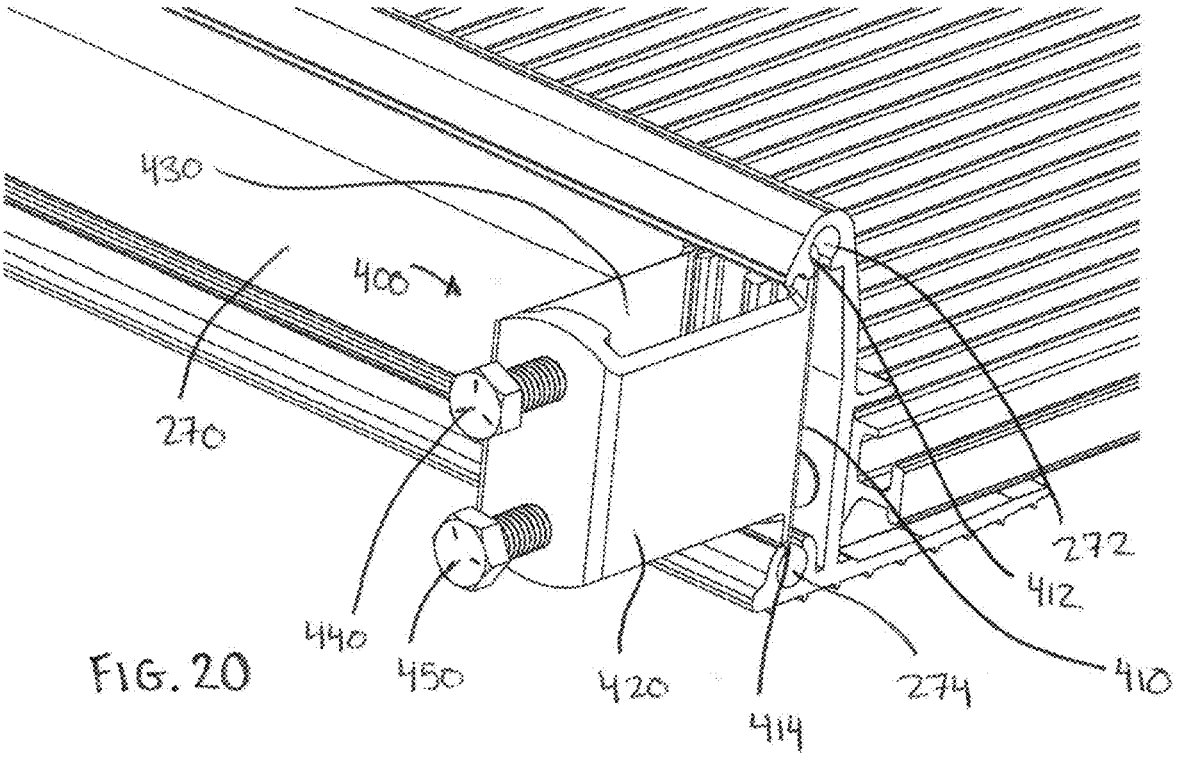

Referring to FIGS. 7-15, as noted above, a ramp assembly 200 may be engaged to platform assembly 100 via connector panel 130 and one or more hangers 180. Ramp assembly 200 may include a plurality of ramp panels 210 engaged with one another and arranged transversely with respect to a length of ramp assembly 200. Ramp panels 210 may be similar to platform panels 110 (FIGS. 2-6) and, in some configurations, may be the same component just cut to a different length depending on the desired width of the ramp assembly 200. The ramp panels 210 may be engaged with one another in a similar manner as with platform panels 110 to achieve a desired length of ramp assembly 200. Each ramp panel 210 generally includes a plate portion 212, a first connector 214 along a first side of the plate portion 212, a second connector 216 along a second side of the plate portion 212, and a rib member 218 extending along plate portion 212 at an intermediate position between first and second connectors 214, 216. Rib member 218 may define a c-shaped channel 219 which serves as a screw boss capable of receiving and securing therein a screw "S," as detailed above. Ramp panels 210 may further define a c-shaped channel 217*a* on a rib member 217*b* extending from first and/or second connectors 214, 216. For example, as illustrated in FIGS. 10-12, second connector 216 may include a rib member 217*b* extending downwardly therefrom and including a c-shaped channel 217*a* defined on rib member 217*b*. More specifically, the rib member 217*b* of the end ramp panel 210 of ramp assembly 200 may define a more robust configuration, including an increased thickness, to increase strength at the joint between ramp assembly 200 and platform assembly 100 and or to increase strength at the joint between ramp assembly 200 and ramp assembly 200 as illustrated in FIGS. 14 and 15. A c-shaped channel 217*a* may be disposed on the increased-thickness rib member 217*b*, and/or may be defined on any other ramp panel 210 at either end thereof. Platform panels 110 (FIGS. 2-4) may be formed in a similar manner.

Figure 5:
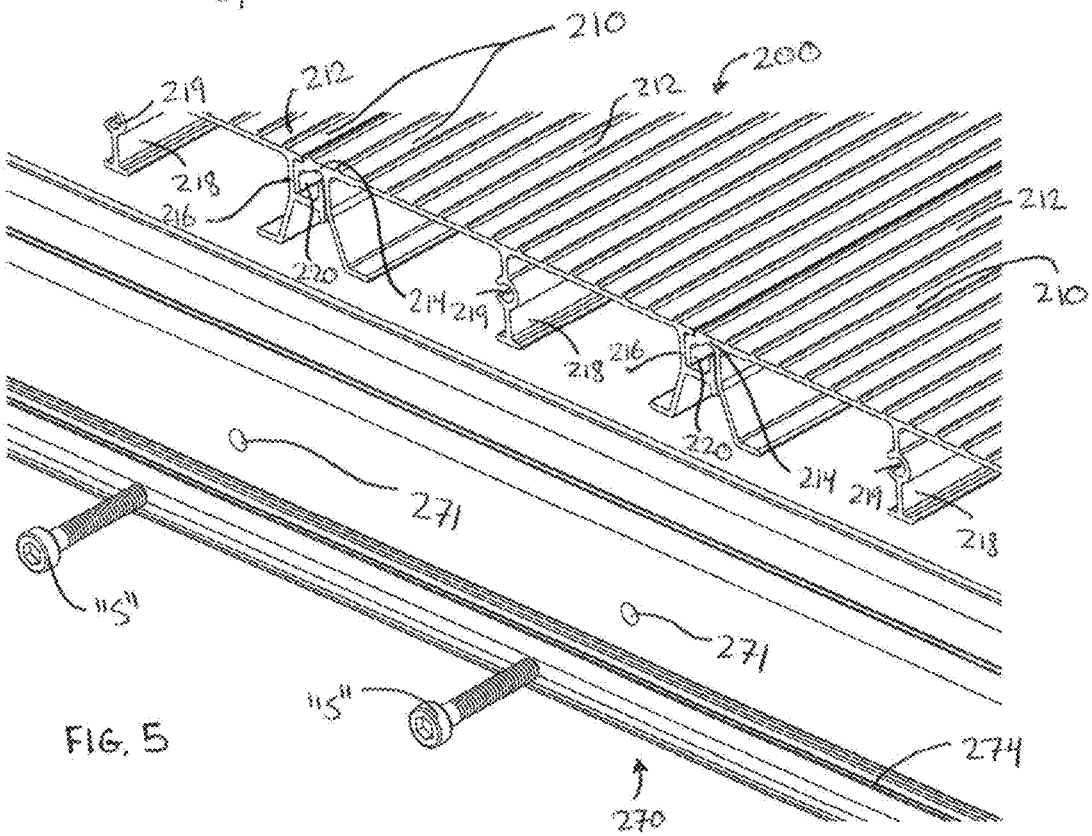
FIG. 5 is an exploded, perspective view illustrating engagement of a side rail with ramp panels of the ramp assembly.

With additional reference to FIG. 5, ramp assembly 200 may also include side rails 270. As noted above, similar side rails 270 may be utilized to engage platform panels 110 along the sides of platform assembly 100 (see FIG. 5) and, in some configurations, the side rails may be the same component, cut to a desired length. Further, as also noted above, side rails 270 may be the same component as the connector panels 130, but in an up-side-down orientation, or may be different components.

Side rails 270 each include a plurality of screw apertures 271 and upper and lower opposed c-shaped channels 274 (only the lower c-shaped channel 274 is visible in FIG. 5). Screw apertures 271 enable fasteners, e.g., screws "S," to be inserted through side rails 270 and into engagement within the c-shaped channels 219 of rib members 218 of ramp panels 210 and/or the screw bosses 220 formed by the first and second connectors 214, 216 of adjacent ramp panels 210 to thereby secure the side rail 170 in position extending along the ends of the ramp panels 210. Upper and lower opposed c-shaped channels 274 (only the lower c-shaped channel 274 is visible in FIG. 5) are similar in configuration and function as those of webs 134 of connector panels 130 (see FIGS. 3, 4, and 6) and, as noted above, may be the same component turned up-side-down.

Figure 7:
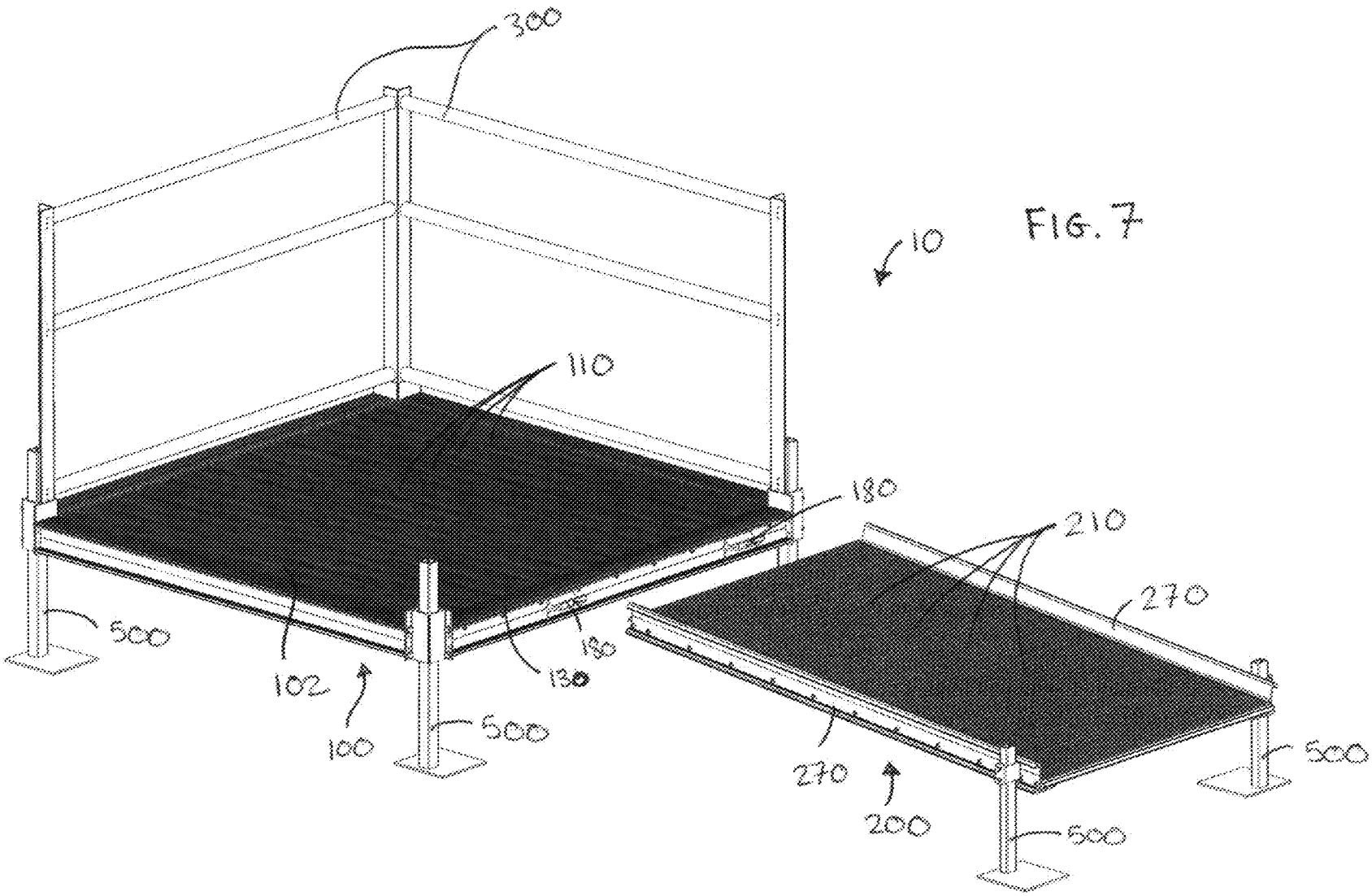
FIGS. 7-9 are progressive, perspective views illustrating engagement of a ramp assembly of the modular accessibility system with the platform assembly via hangers.

With more particular reference to FIGS. 7-11, and initially to FIGS. 7-9, in order to engage ramp assembly 200 with platform assembly 100 via connector panel 130 and hangers 180, the ramp assembly 200 is maneuvered such that the rib member 217*b* extending downward from the exposed first connector 214 of the end ramp panel 210 of ramp assembly 200 (although it could also be the rib member (not shown) extending downward from the exposed second connector 216 of the other end ramp panel 210 of ramp assembly 200, if ramp assembly 200 were oriented oppositely), is seated at least partially within the receiving area 185 of the saddle 184 of each of the hangers 180. With reference to FIGS. 10 and 11, once the rib member 217*b* is seated within saddles 184, the clamp screw 189 of each saddle 184 may be sufficiently tightened, e.g., sufficiently extended into receiving area 185, such that each clamp screw 189 is urged into the rib member 217*b* of the first connector 214 to retain the ramp panel 210 in position, thereby engaging ramp assembly 200 in abutment with connector panel 130.

As illustrated in FIG. 12, engagement between ramp assembly 200 and connector panel 130 can be further secured, in the vertical direction in particular, via tucking first connector 214 underneath the narrow segment 133*b* of plate portion 132 of connector panel 130 to establish a tongue and groove engagement similarly as detailed above with respect to the engagement of first and second connectors 114, 116 of platform panels 110 of platform assembly 100 (see FIGS. 3 and 4). Once this position is achieved, each clamp screw 189 may be tightened as noted above to secure the engagement between the ramp assembly 200 and the connector panel 130.

Referring to FIGS. 13, 14 and 15, multiple ramp assemblies 200 may be engaged with one another with the adjacent end ramp panels 210 of each ramp assembly 200 being engaged similarly as detailed above with respect to engagement of platform panels 110 of platform assembly 100 with one another (see FIGS. 3 and 4). That is, the first connector 214 of the end ramp panel 210 of one of the ramp assemblies 200 is fit within the adjacent second connector 216 of the end ramp panel 210 of the other ramp assembly 200 to engage the ramp assemblies 200 and define screw bosses 220. A fastener, e.g., a screw "S" (FIG. 4), alone or inserted through a side rail 270, may be engaged within the screw boss 220 to secure the ramp assemblies 200 to one another. Alternatively, as illustrated in FIGS. 14 and 15, another fastener, e.g., a set screw "SS," may be engaged within the screw boss 220 to secure the ramp assemblies 200 to one another.

Turning to FIGS. 16-24, as noted above, modular accessibility system 10 includes one or more hand railing assemblies 300 supported by the platform assemblies 100 and/or ramp assemblies 200, and one or more legs 500 supporting the platform assemblies 100 and ramp assemblies 200. In order to enable efficient and effective attachment of hand railing assemblies 300 and/or legs 500 to platform assemblies 100 and/or ramp assemblies 200, brackets 400 are provided. More specifically, brackets 400 are configured for operable coupling with side rails 270 of platform assemblies 100 and/or ramp assemblies 200, respectively. Thus, although brackets 400 are detailed below with respect to engagement with a side rail 270 of a ramp assembly 200, it is understood that the below similarly applies to the engagement of brackets 400 with the side rails of platform assemblies 100 and/or the connector panels 130 of platform assemblies 100.

Referring to FIGS. 17-20, each bracket 400 includes a base 410 including first and second flanges 412, 414 extending from opposing ends thereof. Each bracket 400 further includes a u-shaped frame 420 monolithically formed with or otherwise engaged to base 410 to define a generally rectangular passageway 430 extending through bracket 400. First and second vertically-spaced clamp screws 440, 450 are operably engaged with u-shaped frame 420 and configured for selective extension into and withdrawal from passageway 430, independently of one another.

With continued reference to FIGS. 17-20, in order to engage a bracket 400 within a side rail 270, the bracket 400 is first rotated to a horizontal orientation wherein flanges 412, 414 are horizontally-oriented. In this position, bracket 400 may be inserted transversely into side rail 270 between the upper and lower c-shaped channels 272, 274, respectively, thereof. Once inserted in this manner, bracket 400 is rotated back to a vertical orientation wherein flanges 412, 414 are vertically-oriented and extend through the slots defined within upper and lower c-shaped channels 272, 274 into upper and lower c-shaped channels 272, 274, respectively. In this manner, bracket 400 is inhibited from being removed from side rail 270, but may freely slide therealong, at least at this point.

Figure 21:
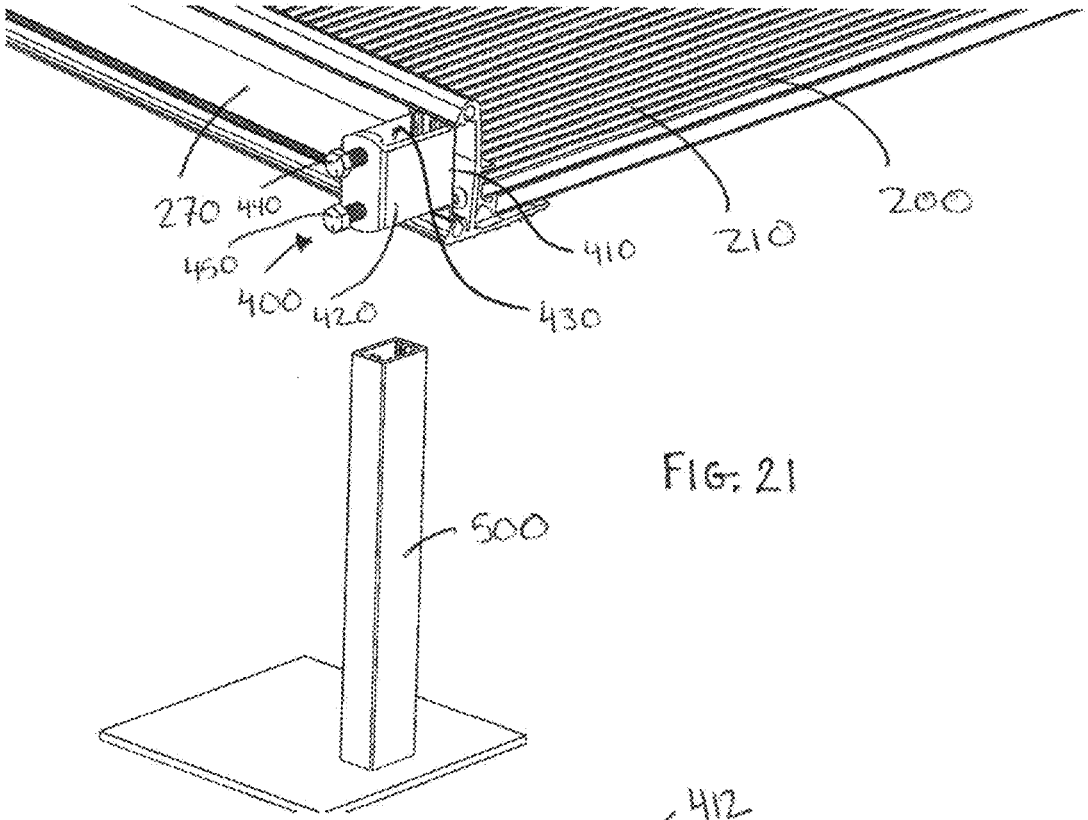
FIG. 21 is an exploded, perspective view illustrating insertion of a leg into the bracket.
Figure 22:
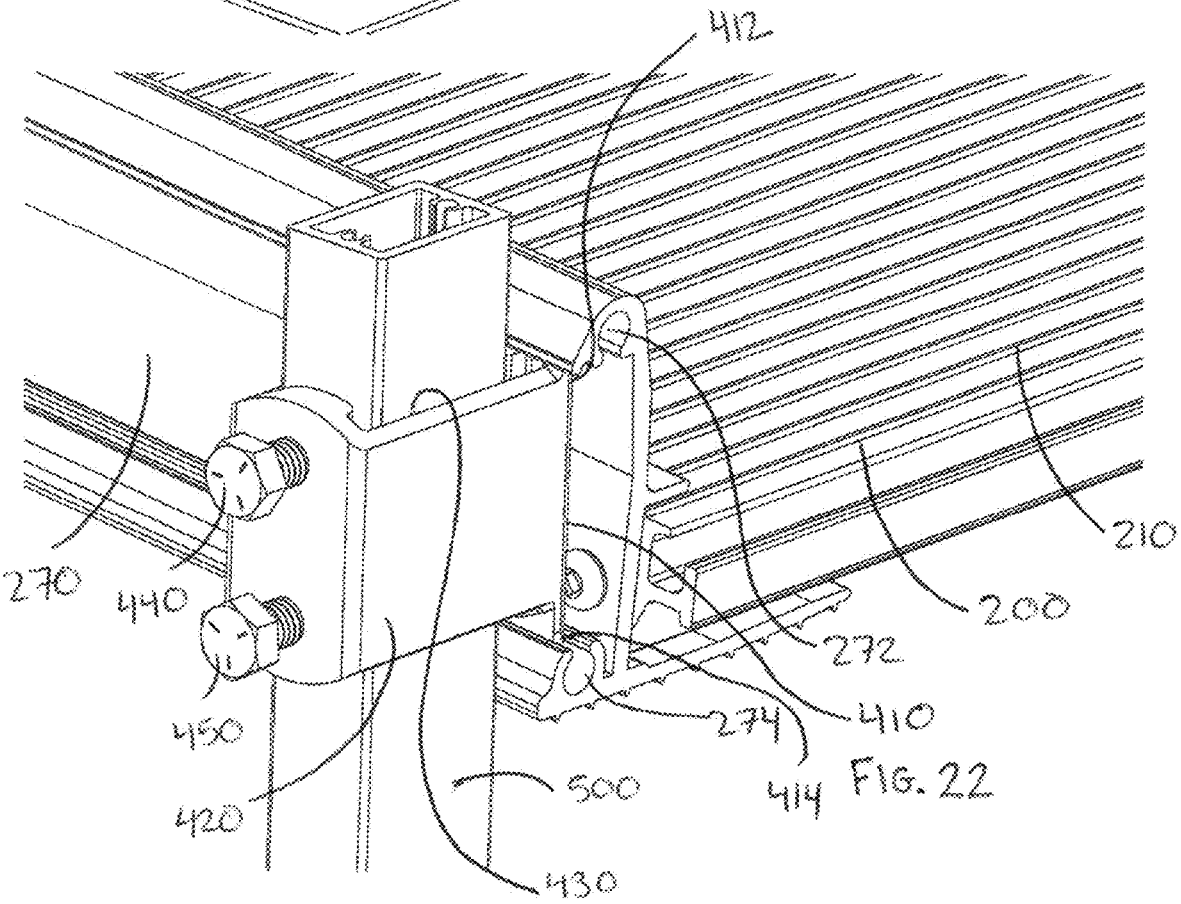
FIG. 22 is a perspective view illustrating engagement and securement of the leg within the bracket engaged with the ramp assembly.

Turning to FIGS. 21-22, to engage a leg 500 with bracket 400, for example, leg 500 is inserted vertically through passageway 430 to a desired position, for example, depending upon the desired height of ramp assembly 200 at that location. Once the desired position has been reached, clamp screws 440, 450 are tightened against leg 500 to retain leg 500 in the desired position. The tightening of clamp screws 440, 450 also serves to urge leg 500 into contact with side rail 270 in press-fit engagement therewith, thereby inhibiting bracket 400 from sliding along side rail 270. The brackets 400 ability to slide along and rotate relative to the side rail 270 makes it easily adjustable. When installing a ramp for example this versatility allows adjustment, which can accommodate varying degrees of slope (e.g., 0° to 45° or more specifically a 4.8 degree angle; 8.3% grade as is regulated for hand-propelled wheelchair and/or 7.1 degree angle; 12.5% grade as is regulated for powered wheelchairs) as well as repositioning a leg 500 along the length of a ramp to accommodate for terrain variations or obstacles encountered during an installation.

Figure 23:
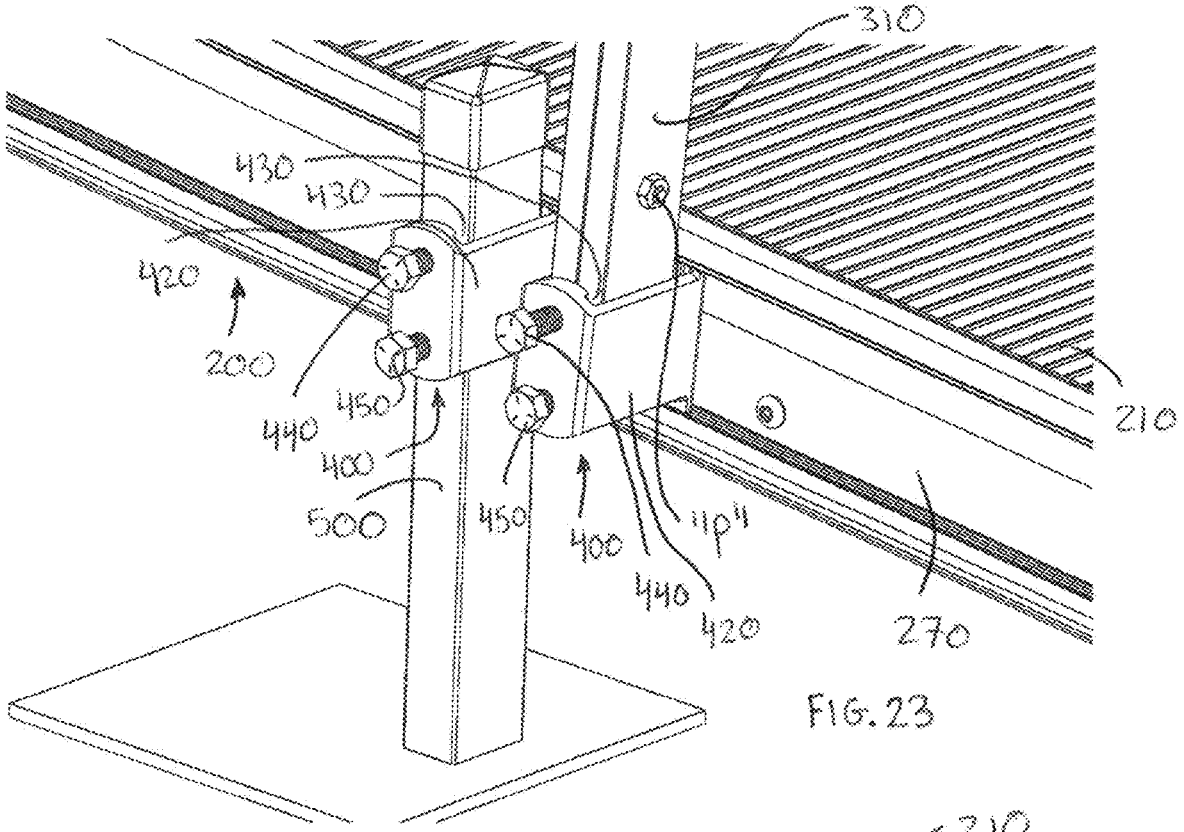
FIGS. 23 and 24 are perspective views illustrating engagement and securement of the hand railing assembly with another bracket engaged with the ramp assembly.
Figure 24:
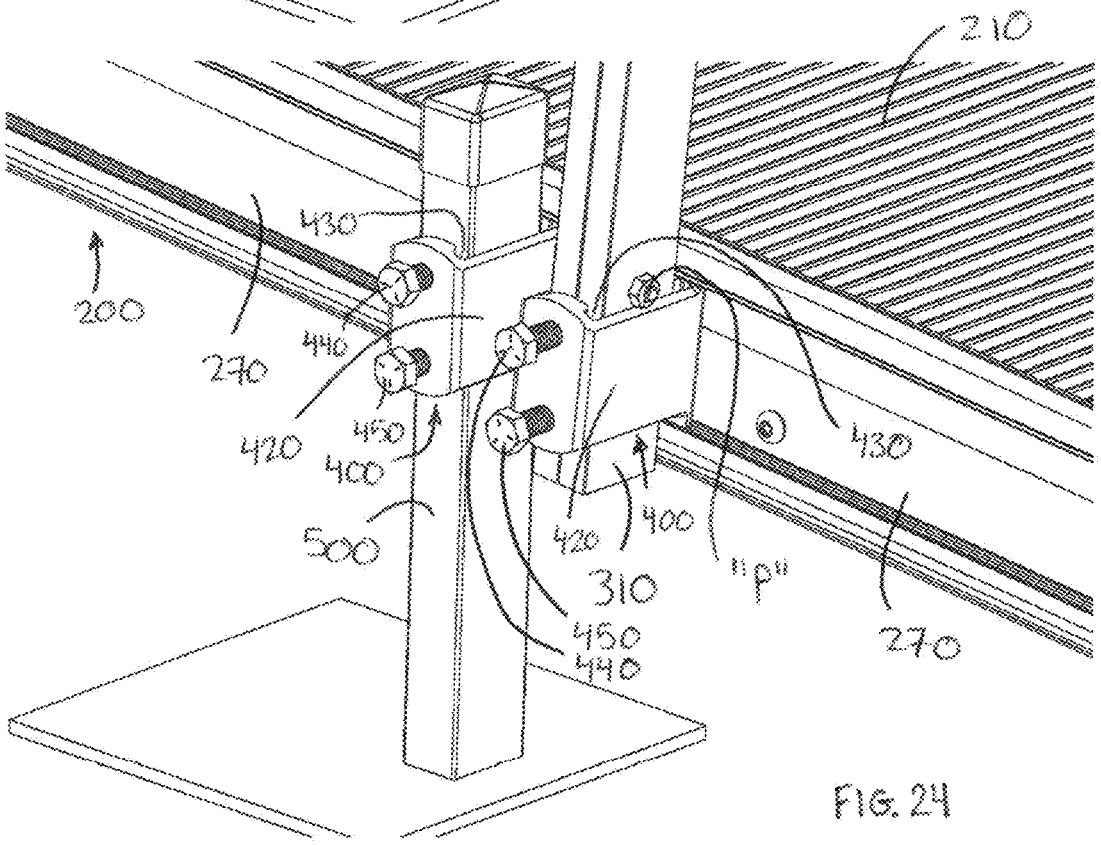

Referring to FIGS. 23 and 24, to engage a hand railing assembly 300 with bracket 400, a post assembly 310 of the hand railing assembly 300 is inserted vertically through passageway 430 to a desired position, similarly as detailed above with respect to the engagement of leg 500 (FIGS. 21 and 22). Alternatively, second clamp screw 450 may be sufficiently extended into passageway 430 such that the post assembly 310 may be inserted into passageway 430 and sit atop the portion of second clamp screw 450 extending into passageway 430. In this manner, the hand railing assembly 300 may be assembled before being fully engaged with bracket 400, whereby second clamp screw 450 is withdrawn and post assembly 310 moved to the desired final position before tightening first clamp screw 440 and re-tightening second clamp screw 450 against post assembly 310. Additionally or alternatively, a pin "P" or other suitable structure protruding from post assembly 310 may contact bracket 400 to set a depth of insertion of post assembly 310 into bracket 400. In either configuration, once the desired final position of post assembly 310 has been achieved, clamp screw 440 and/or clamp screw 450 may be tightened against post assembly 310 to retain post assembly 310 in the desired position while also inhibiting bracket 400 from sliding along side rail 270, similar to engaging the leg 500, as detailed above.

Turning now to FIGS. 25-48, hand railing assemblies 300 provided in accordance with the present disclosure and configured for use with modular accessibility system 10 (FIG. 1) or independently thereof are described. The hand railing assemblies 300 may take various forms depending upon particular needs. Some of such configurations are detailed below, although other configurations are also contemplated.

Figure 25:
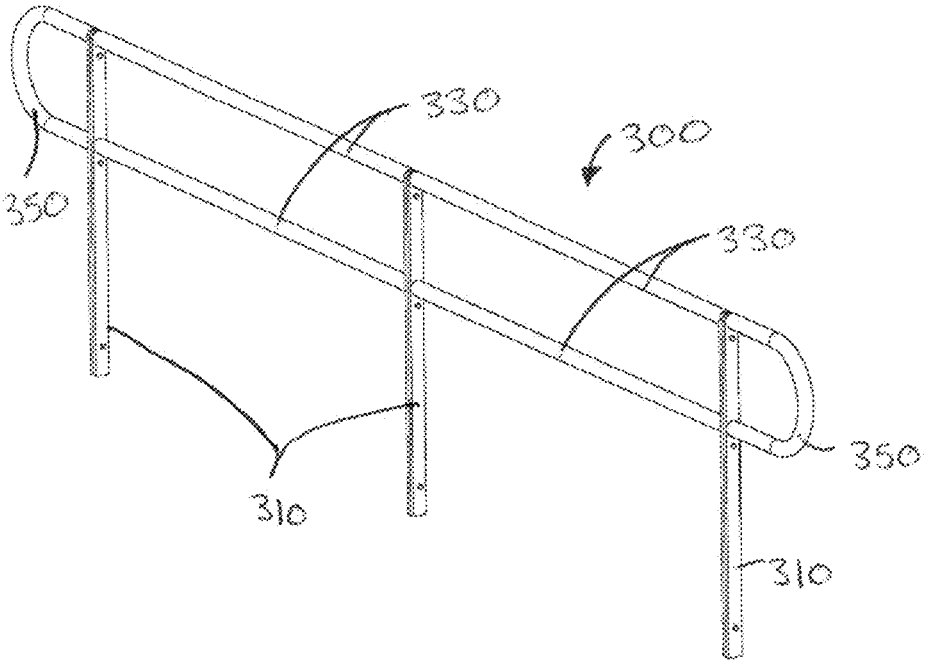
FIGS. 25 and 26 are perspective views of different configurations of a hand railing assembly in accordance with the present disclosure.
Figure 26:
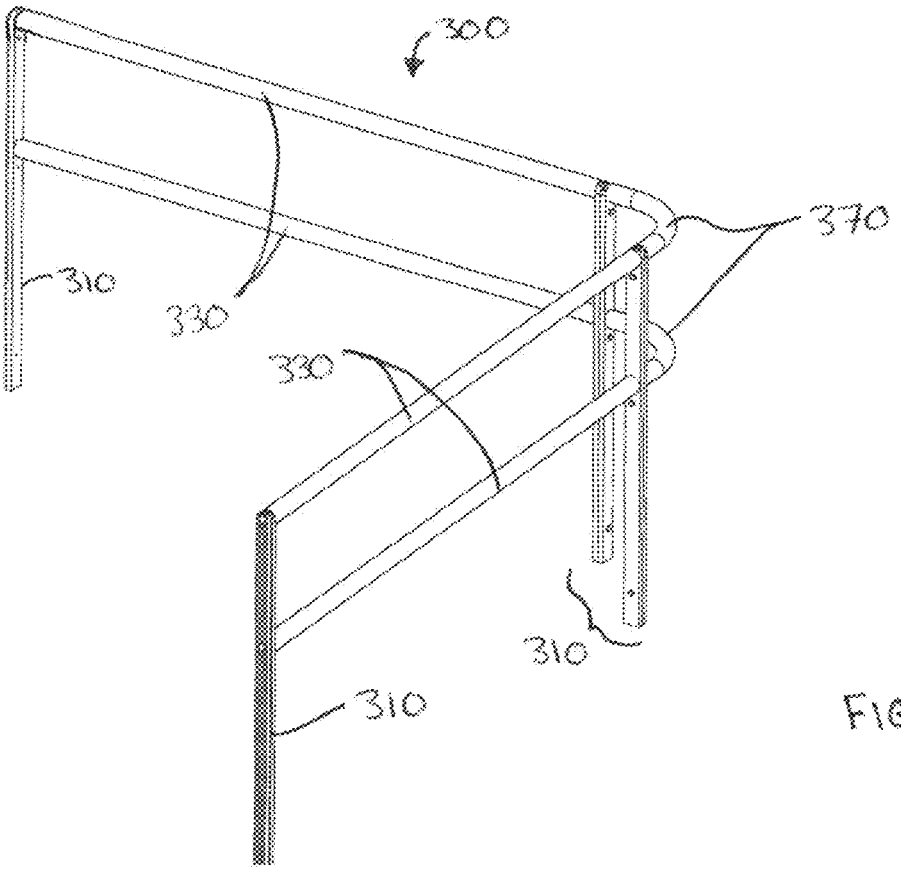
Figure 27:
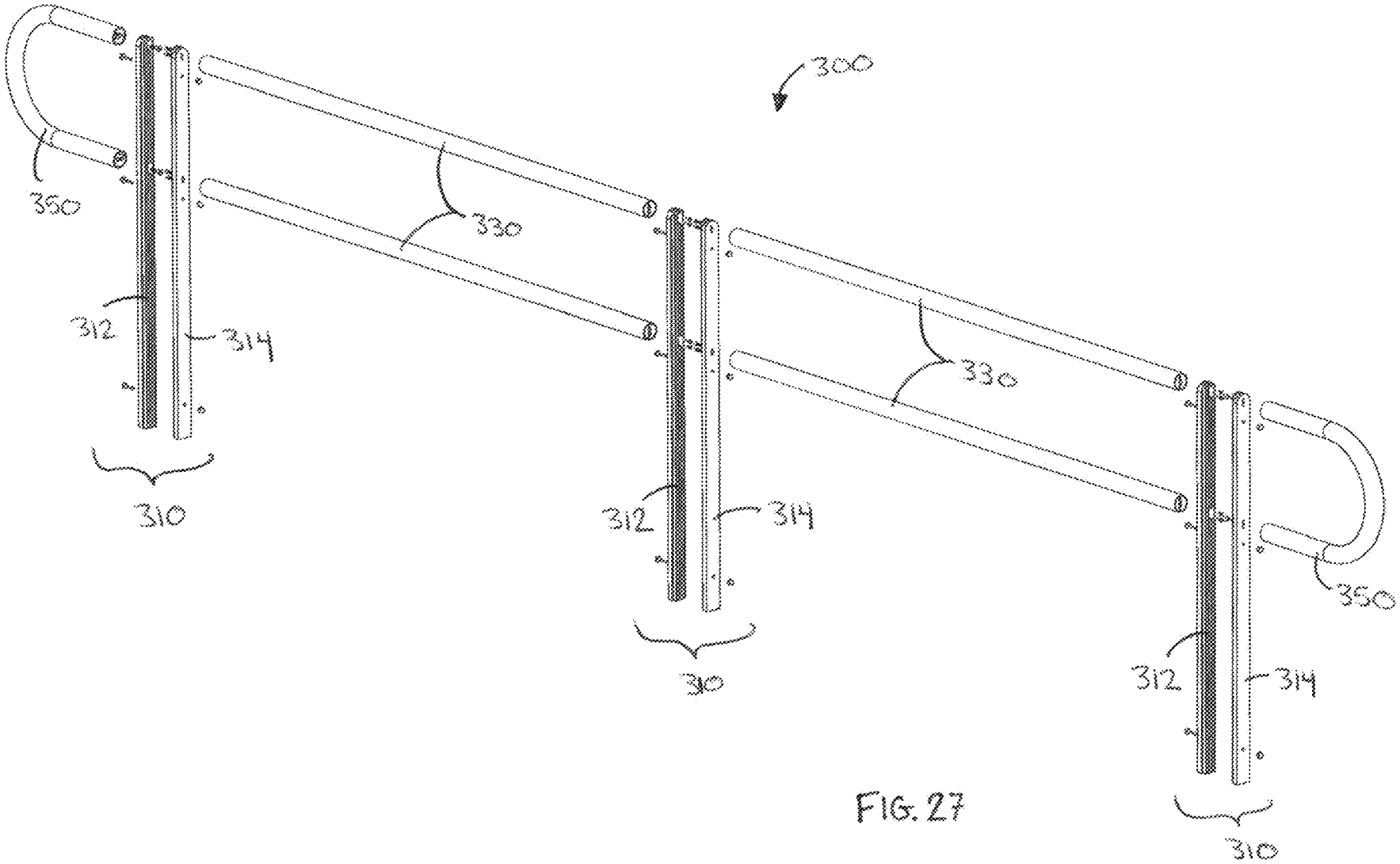
FIG. 27 is an exploded, perspective view of the hand railing assembly.
Figure 28:
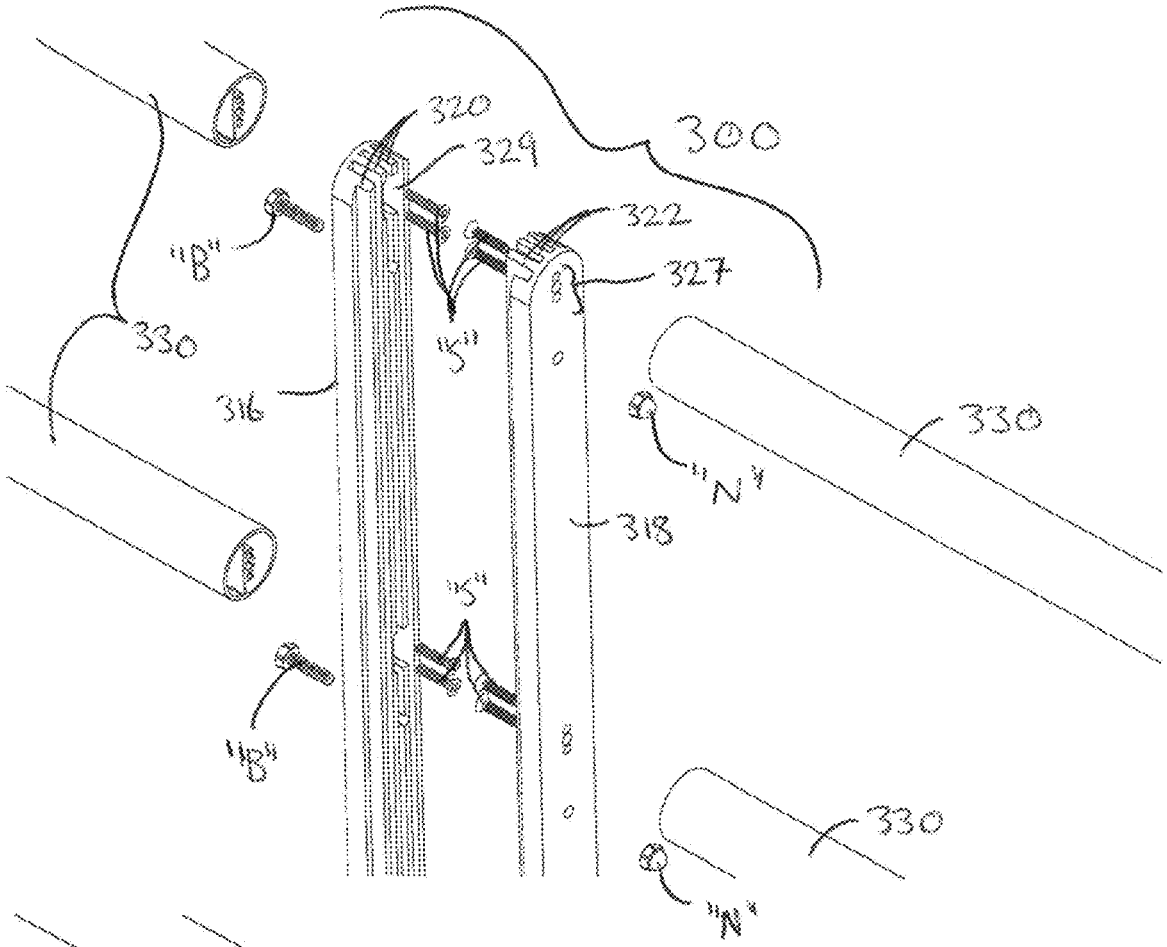
FIG. 28 is an exploded, perspective view illustrating engagement of rails and post assemblies of the hand railing assembly.

With initial general reference to FIGS. 25-27, each hand railing assembly 300 generally includes one or more post assemblies 310, one or more intermediate rails 330, and one or more end rails 350. Curved connector rails 370 (FIGS. 26 and 40) and/or pivoting connectors 390 (FIGS. 41 and 42) may also be provided. Additionally or alternatively, spindles 600 (FIGS. 43-47), obstruction panels 700 (FIGS. 43-47), and/or projection surfaces 800 (FIG. 48) may be provided.

Figure 29:
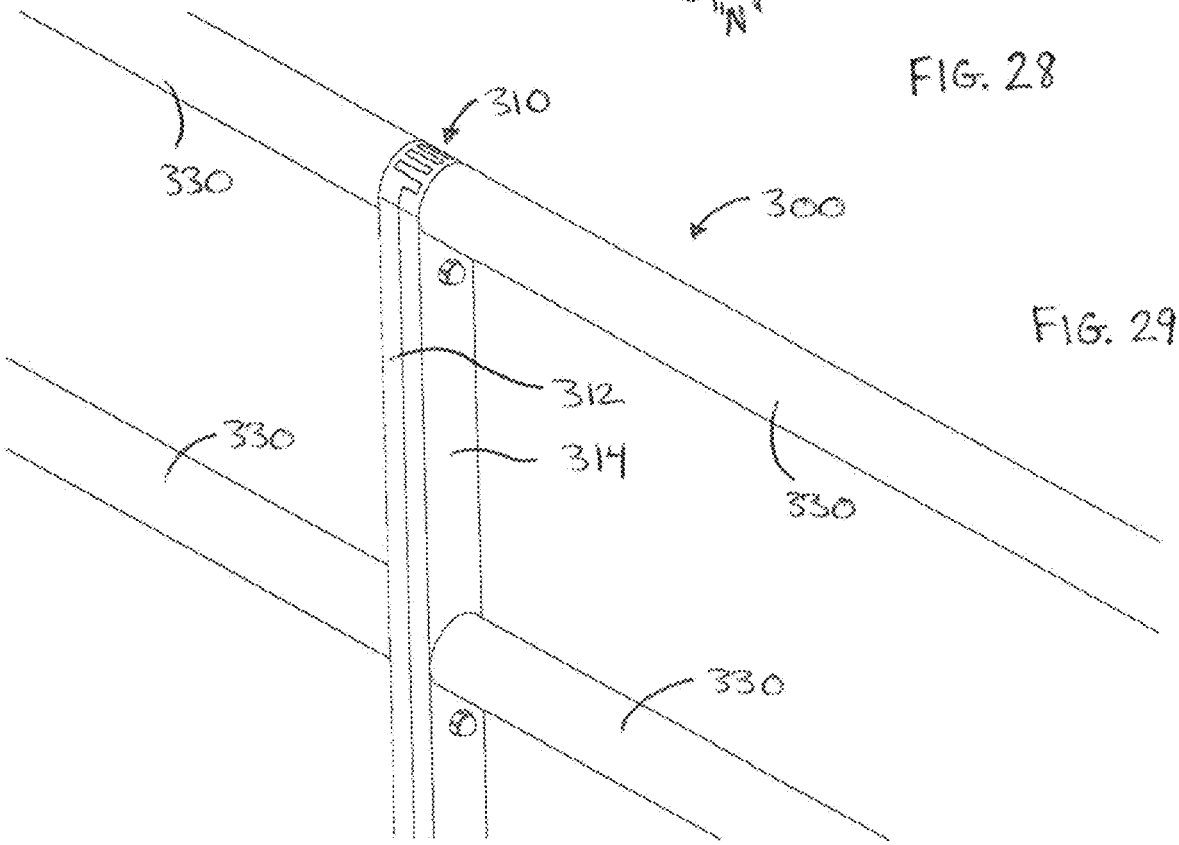
FIG. 29 is a perspective view illustrating the rails and post assemblies engaged with one another.
Figure 30:
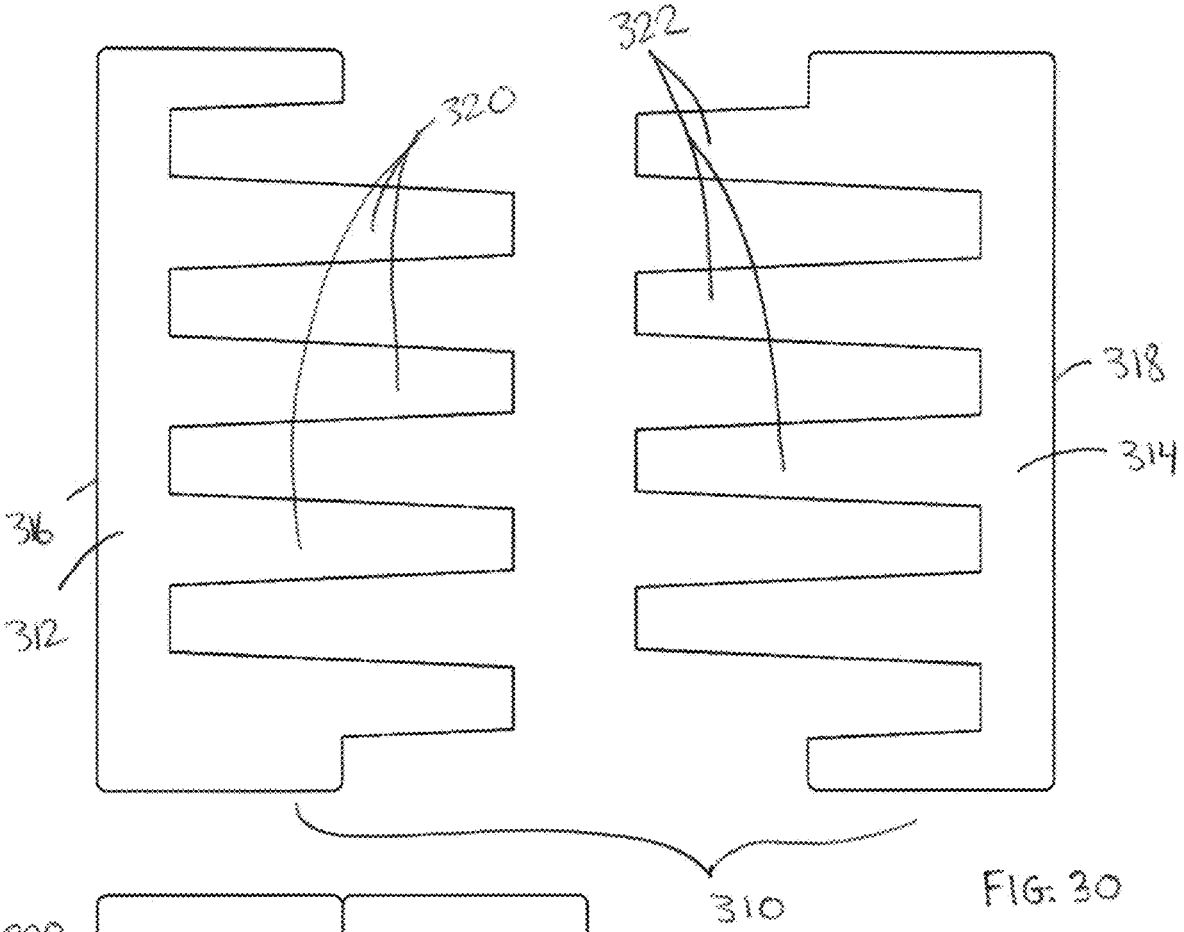
FIGS. 30 and 31 are schematic drawings illustrating an engagement configuration of the components of a post assembly.
Figure 31:
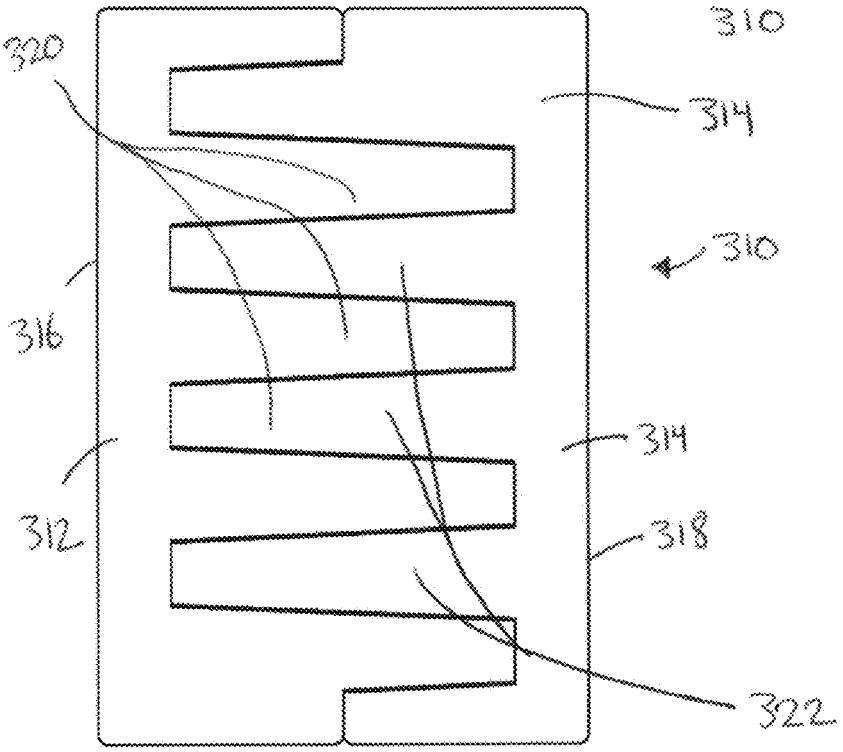
Figure 32:
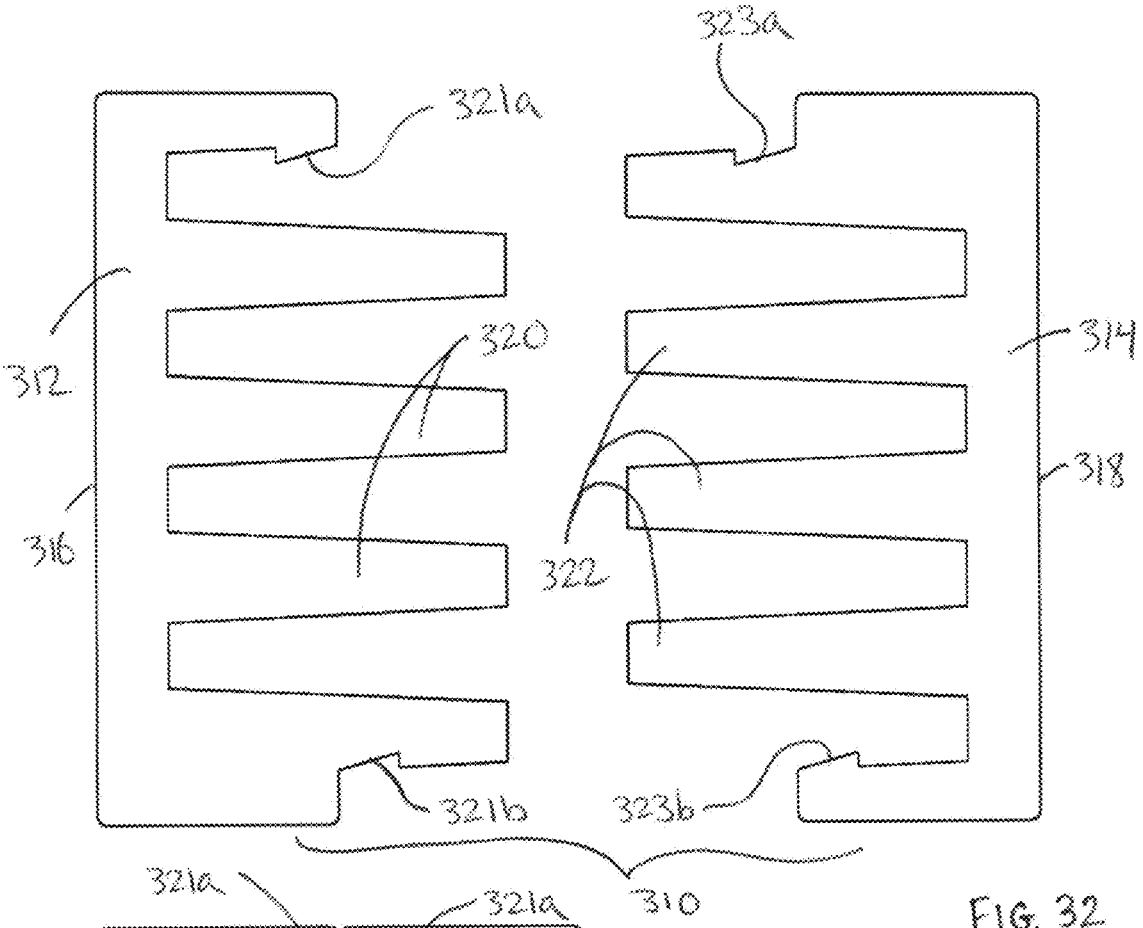
FIGS. 32 and 33 are schematic drawings illustrating another engagement configuration of the components of a post assembly.
Figure 33:
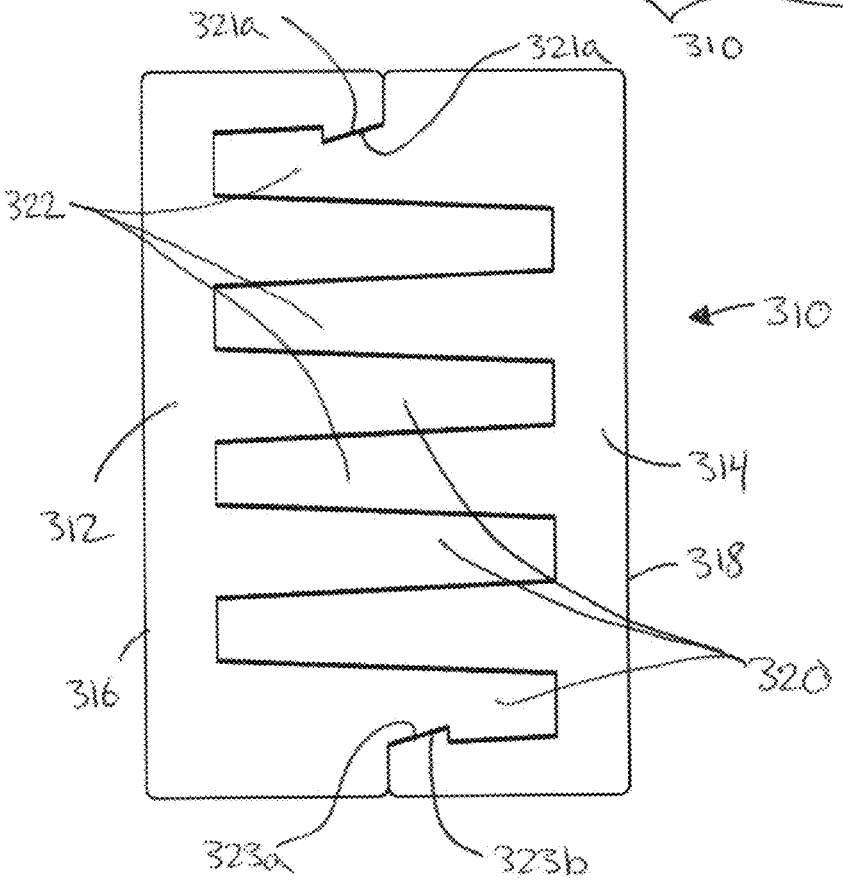

Referring to FIGS. 27-35, each post assembly 310 may includes first and second post components 312, 314 configured to engage one another in inter-fit manner, as detailed below. First and second post components 312, 314 each define a plate-like configuration including opposing sides and may each be formed as a single, monolithic component. Generally flat surfaces 316, 318 are defined on the outwardly-facing sides of first and second post components 312, 314, respectively, while a plurality of spaced-apart ribs 320, 322 which in FIGS. 30-33 appear similar to fingers that extend from the inwardly-facing sides of first and second post components 312, 314, respectively. Ribs 320 of first post component 312 are offset relative to ribs 322 of second post component 314 to enable post components 312, 314 to engage one another with ribs 320, 322 in an inter-fit manner such that first and second post components 312, 314 are laterally fixed relative to one another. As illustrated in FIGS. 30 and 31, this may be sufficient to engage first and second post components 312, 314 with one another. Alternatively, as illustrated in FIGS. 32 and 33, some ribs 320, 322, e.g., the outer-most ribs, of first and second post components 312, 314 may include complementary snap-fit features 321*a*, 321*b* and recesses 323*a*, 323*b*, e.g., corresponding protrusions and recesses, to further engage first and second post components 312, 314 in snap-fit manner in addition to the inter-fit engagement therebetween. First and second post components 312, 314 may be the same component, e.g., two of the same component oriented to face one another. Alternatively, first and second post components 312, 314 may be different from one another, e.g., one being a male component and the other a complementary female component.

Figure 34:
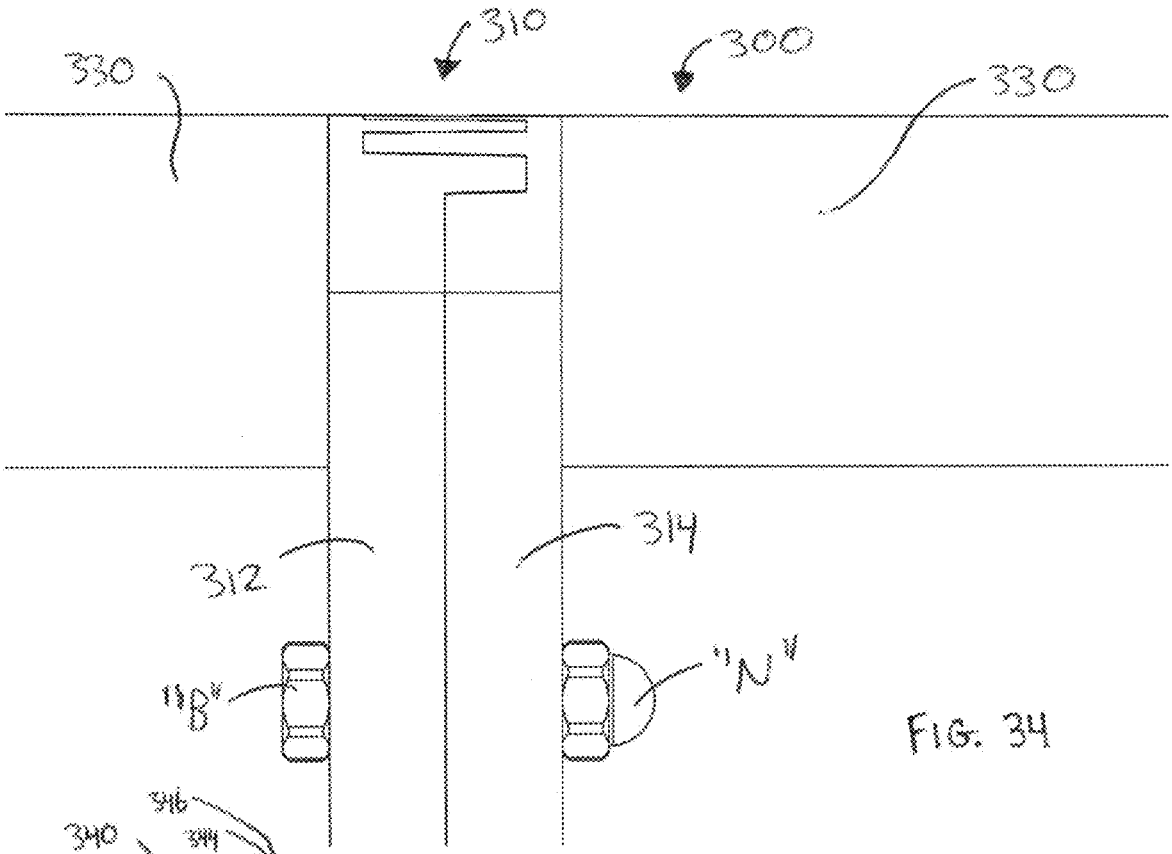
FIG. 34 is a side view illustrating the rails and post assemblies engaged with one another.
Figure 35:
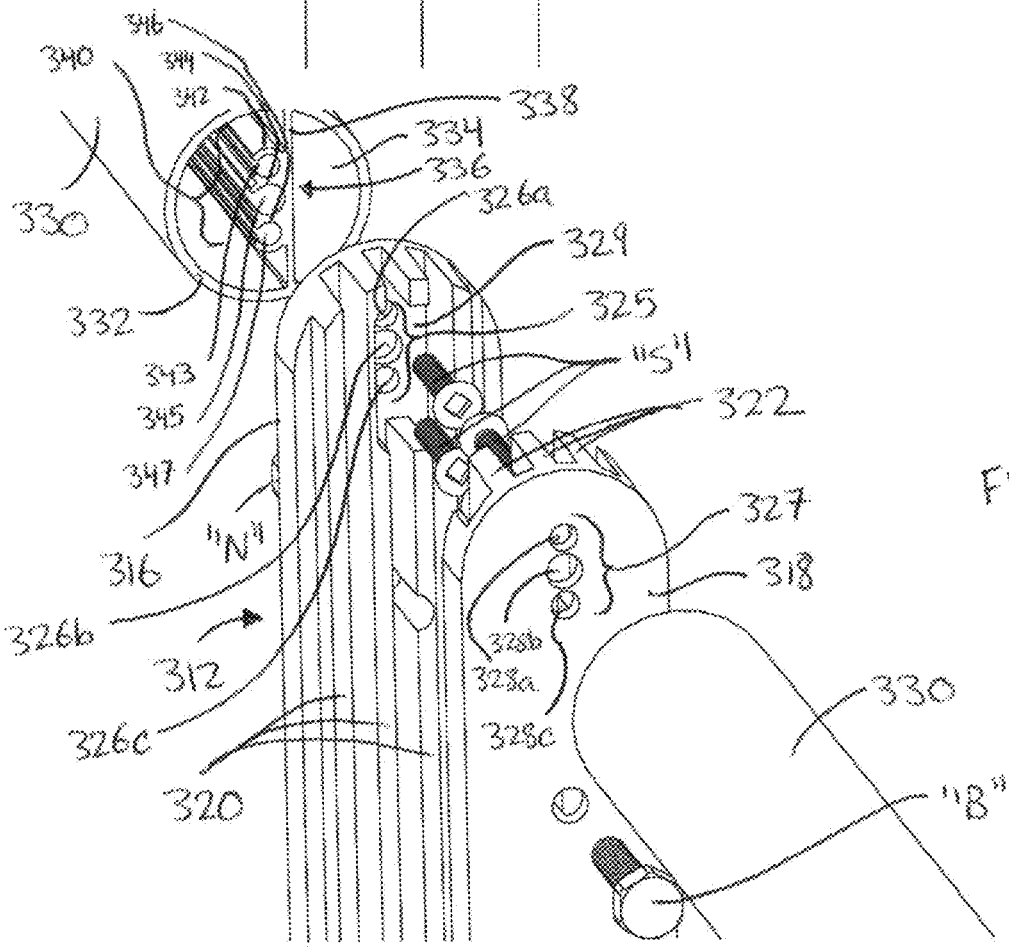
FIG. 35 is another exploded, perspective view illustrating the rails and post assemblies engaged with one another.

Referring to FIGS. 34 and 35, in configurations where only inter-fit engagement is provided between first and second post components 312, 314 (see FIGS. 30 and 31), a bolt "B" and nut "N" may be utilized to secure first and second post components 312, 314 with one another. With respect to embodiments where snap-fit engagement is also provided, bolt "B" and nut "N" need not be utilized, but may, if so desired.

Continuing with reference to FIG. 35, first and second post components 312, 314 each further defines one or more sets of apertures 325, 327, respectively, which may be configured to align with one another upon engagement of first and second post components 312, 314. Each post component 312, 314 may include multiple sets of aperture 325, 327, which may be located at various positions along the length thereof. For example, first sets of aperture 325, 327 may be disposed at the upper ends of first and second post components 312, 314, second sets of apertures 325, 327 may be disposed towards but spaced-apart from the upper ends of first and second post components 312, 314, and/or third sets of apertures 325, 327 may be disposed towards but spaced-apart from the lower ends of first and second post components 312, 314 (see FIGS. 43, 45, and 47).

As illustrated in FIG. 35, each set of apertures 325, 327 of the first and second post components 312, 314, respectively, includes three apertures 326*a*, 326*b*, 326*c* and 328*a*, 328*b*, 328*c* disposed in vertical registration with one another. However, it is also contemplated that other suitable arrangements be provided, e.g., different numbers of apertures and/or different orientations thereof such as horizontal registration. One or more of the aperture 326*a*, 326*b*, 326*c* and 328*a*, 328*b*, 328*c* of each of the first and second post components 312, 314, respectively, is configured to receive a screw "S" therethrough, wherein the heads of the screws "S" are disposed on the inwardly-facing sides of first and second post components 312, 314, respectively, and the shanks of the screws "S" extend through first and second post components 312, 314 and outwardly from the outwardly-facing sides thereof. As detailed below, such a configuration enables engagement of screws "S" with intermediate rails 330, end rails 350, and/or other suitable rails. Pockets 329 surrounding sets of apertures 325, 327 may be defined within one or more of ribs 320, 322 of first and second post components 312, 314 to accommodate the heads of screws "S" when first and second post components 312, 314 are engaged with one another. Pockets 329 my be a feature that is molded into the first and second post components 312, 314 or may be created by removing of a portion (e.g., by a machining operation) of one or more ribs as can be seen in FIG. 35.

Figure 36:
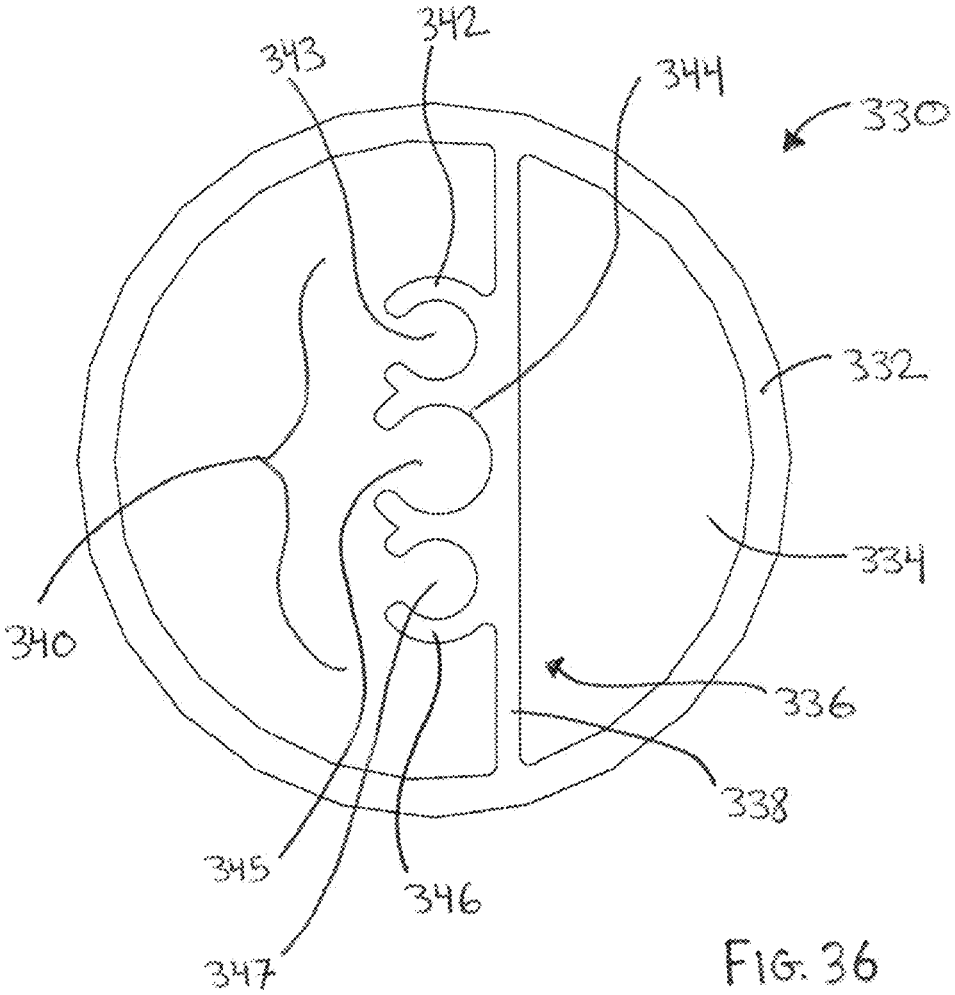
FIG. 36 is an end view of an intermediate rail of the hand railing assembly.

Turning to FIGS. 35 and 36, each rail component configured for use with hand railing assembly 300, e.g., intermediate rails 330, end rails 350, and curved connector rails 370, includes a tube segment of similar configuration and is configured to engage post assemblies 310 in a similar manner. Thus, although described in detail below with respect to intermediate rails 330, it is understood that the following applied similarly to end rails 350 and curved connector rails 370, except as specifically contradicted hereinbelow. Further, although detailed and illustrated herein as being circular in cross-section, the tube segments may alternatively define oval, square, or other suitable cross-sectional configurations, depending upon a particular purpose.

Intermediate rails 330 each include an outer tube 332 defining a hollow interior 334 extending longitudinally therethrough and a web 336 disposed within hollow interior 334. Each intermediate rail 330 may be monolithically formed as a single piece of material, e.g., via extrusion or other suitable process. Web 336 extends across hollow interior 334 and is connected with outer tube 332, on an inner surface of outer tube 322, at opposing ends of web 336. Web 336 defines a plate-like portion 338 and a set of c-shaped channels 340 disposed on plate-like portion 338. For example, the set of c-shaped channels 340 may include three (3) aligned c-shaped channels 342, 344, 346, although other suitable configurations and/or numbers of channels are also contemplated. C-shaped channels 342, 344, 346 define screw bosses 343, 345, 347, respectively, of appropriate dimensions to enable receipt of the shanks of the screws "S" engaged with post assembly 310, as detailed below. C-shaped channels 324, 344, 346 may share walls with adjacent C-shaped channels 324, 344, 346. Instead of C-shaped channels 342, 344, 346, other suitable structure forming screw bosses 343, 345, 347 for the receipt of the shanks of the screws "S" or other fasteners are also contemplated. The C-shaped channels 342, 344, 346, may be positioned adjacent to or remote from the outer tube 322. In some applications it may be desirable to space the C-shaped channels 342, 344, 346 away from the outer tube 322 enough e.g., on web 336) so that the heads of the screws "S" will be hidden from view in the final assembly (e.g., at the top of the post assemblies 310). In this way the pocket 329 will have ribs 320, 322 on all four sides (e.g., above, below, right side and left side) as can be seen in FIG. 35. This configuration will allow the screws "S" to be obscured from view in the final assembly as can be seen in FIG. 29.

Plate-like portion 338 of web 336 may extend across hollow interior 334 of outer tube 332 at a position off-center therefrom such that the c-shaped channels 342, 344, 346 may be centered or positioned on a center line relative to outer tube 332, e.g., aligned on a diameter thereof. Additionally or alternatively, plate-like portion 338 of web 336 may be aligned on the neutral plane of outer tube 332, as detailed below with respect to end rails 350 (FIGS. 37-39).

Referring again to FIGS. 28, 29, and 34-36, in order to couple intermediate rails 330 to one another in end-to-end fashion with post assemblies 310 disposed therebetween, the generally flat surface 316 of the first post component 312 is abutted against the end of one of the intermediate rails 330 such that one set of apertures 325 of first post component 312 is aligned with the set of c-shaped channels 340 of the intermediate rail 330. Thereafter, one or more screws "S" may be inserted through one or more apertures 326*a*, 326*b*, 326*c* of the set of apertures 325 and into engagement within the aligned c-shaped channels 342, 344, 346 of the set of c-shaped channels 340 to engage first post component 312 with the intermediate rail 330. The particular number of screws "S" utilized may depend on a particular purpose or preference. For example, two screws "S" may be utilized and engaged with the outer apertures 326*a*, 326*c* and outer c-shaped channels 342, 346 (as illustrated), a single center screw "S" may be utilized, three screws "S" may be utilized, etc.

Next, the generally flat surface 318 of the second post component 314 is abutted against the end of the other intermediate rail 330 such that one set of apertures 327 of second post component 314 is aligned with the set of c-shaped channels 340 of the intermediate rail 330 and screws "S" are inserted therethrough to engage second post component 314 with the intermediate rail 330, similarly as detailed above. Once first and second post components 312, 314 are each engaged with one of the intermediate rails 330, the first and second post components 312, 324 may be engaged with one another, as detailed above, to thereby couple intermediate rails 330 to one another in end-to-end fashion with the post assembly 310.

Intermediates rails 330 may be provided singularly between post assemblies 310, in pairs, e.g., as illustrated in FIGS. 25-27, wherein each pair of intermediate rails 330 includes upper and lower closely-spaced intermediate rails 330 extending generally parallel to one another between post assemblies 310 or as illustrated in FIGS. 40-47 wherein each pair of intermediate rails 330 includes upper and lower further-spaced intermediate rails 330 extending generally parallel to one another between post assemblies 310, or may be provided in sets of any suitable number.

Figure 40:
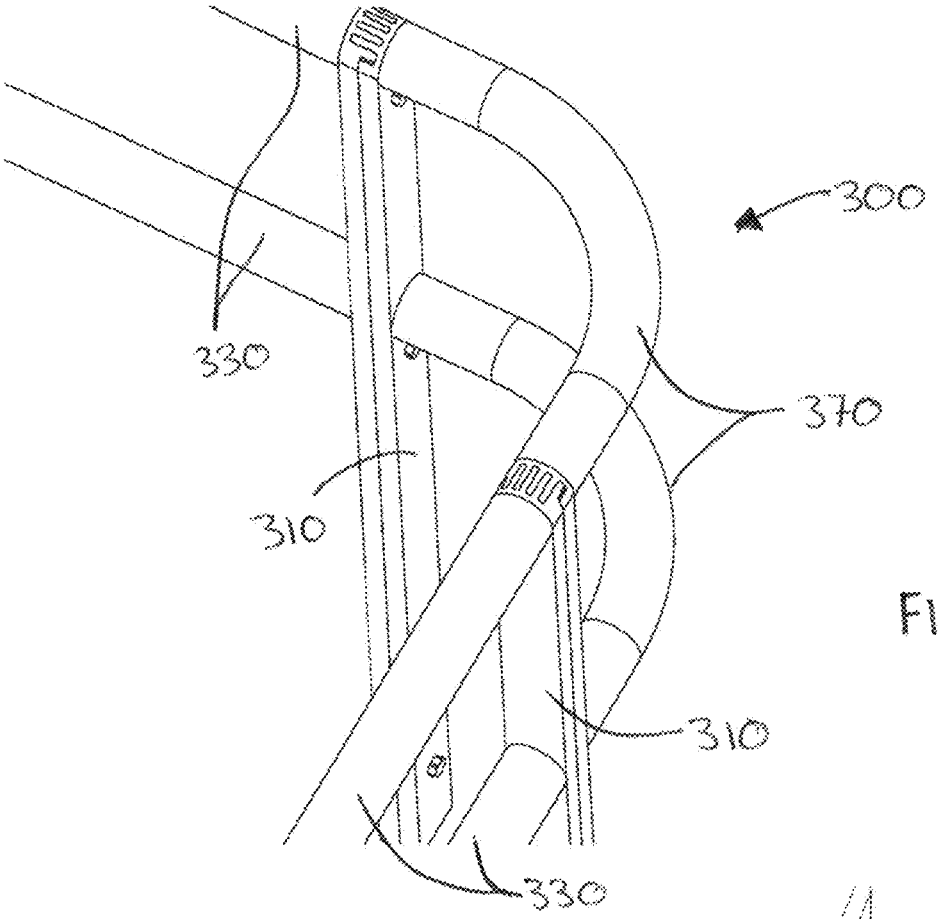
FIG. 40 is a perspective view of another configuration of the hand railing assembly.

Turning now to FIGS. 37-39, an end rail 350 is illustrated including a curved configuration such that first and second ends 351*a*, 351*b* of the end rail 350 are oriented in similar directions. Plate-like portion 358 of web 356 of end rail 350 may be aligned on the neutral plane "NP-NP" of outer tube 332. The neutral plane "NP-NP" is the plane in which a tube, when loaded by a bending force, is not under stress. The material on one side of the neutral plane "NP-NP" (the outer portion of the bend) is in tension as a result of the bending force, and the material on the other side of the neutral plane "NP-NP" (the inner portion of the bend) is in compression as a result of the bending force. Providing the plate-like portion 358 of the web 356 on the neutral plane "NP-NP" eliminates stress from being imparted thereto despite the bend in the end rail 350. Indeed, providing a plate-like portion of the web on any curved component, e.g., end rail 350 or curved connector rail 370, reduces stress therein, as detailed above, regardless of the particular curve configuration. End rails 350 may define any suitable shape, bend angle, or other configuration. Referring to FIG. 40, hand railing assembly 300 is shown including a pair of curved connector rails 370 connected to adjacent intermediate rails 330 via post assemblies 310. Curved connector rails 370 may define any suitable bend angle, e.g., 30, 45, 60, 90, or 180 degrees, depending on a particular purpose.

In some configurations, the intermediate rails 330, end rails 350, and curved connector rails 370 are initially formed from the same component and thereafter bent and/or cut to achieve the desired configuration.

Figure 41:
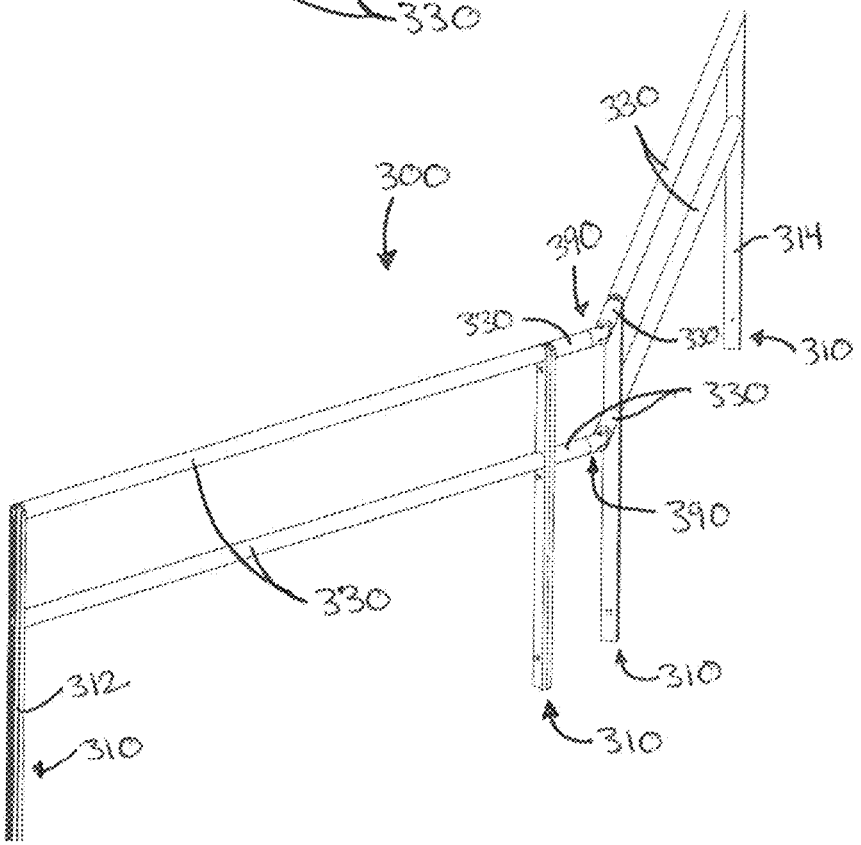
FIG. 41 is a perspective view of still another configuration of the hand railing assembly.
Figure 42:
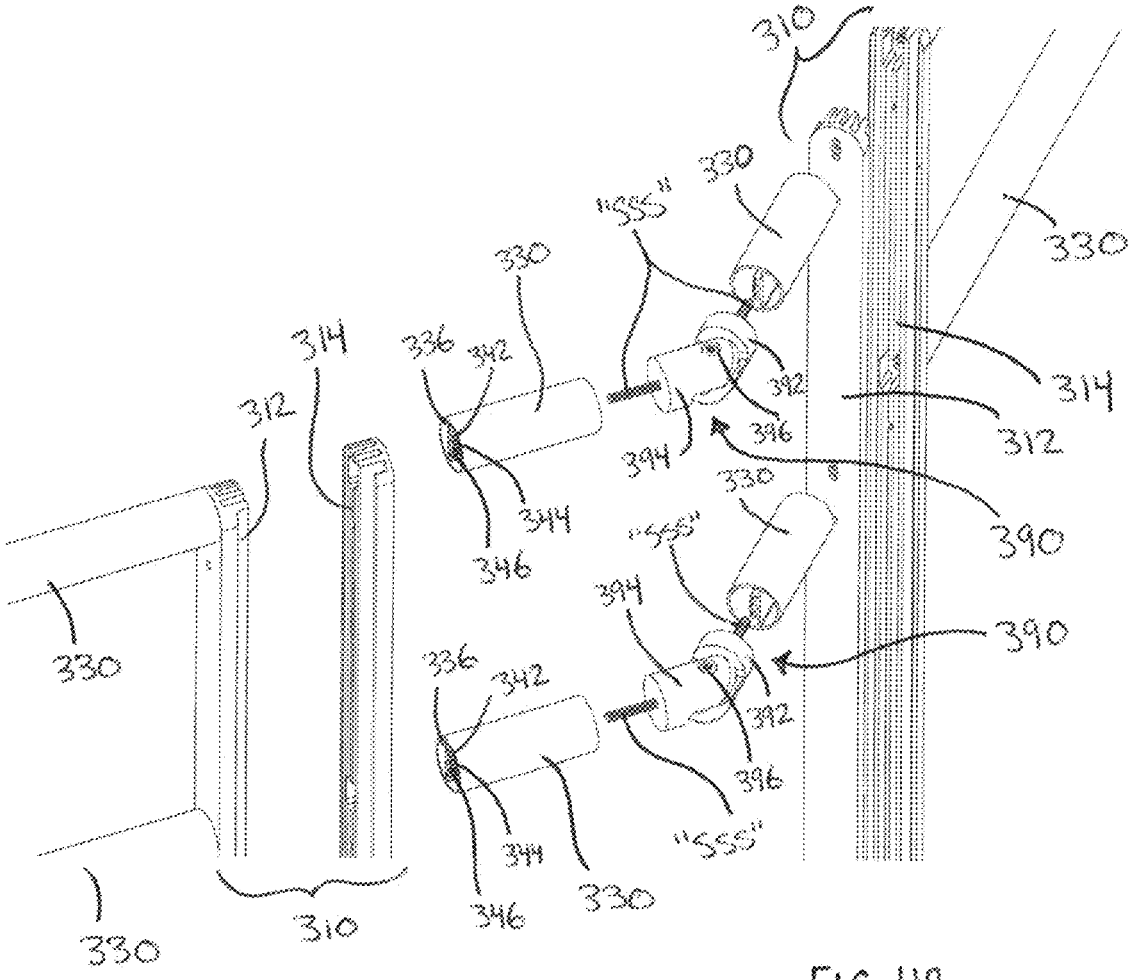
FIG. 42 is an exploded, perspective view of a pivoting connector of the hand railing assembly.
Figure 43:
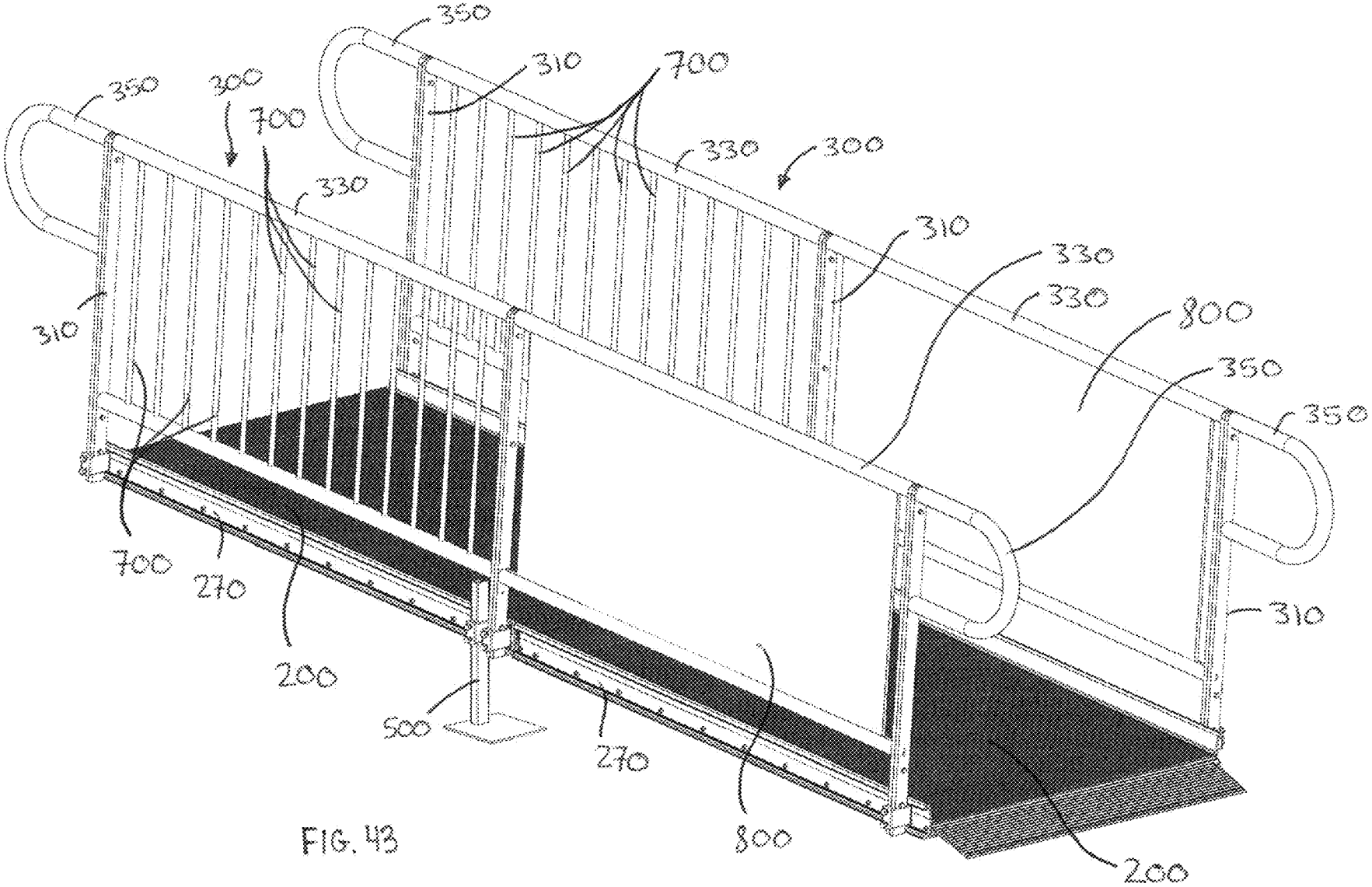
FIG. 43 is a perspective view of the ramp assembly including hand railing assemblies having spindles and obstruction panels.
Figure 44:
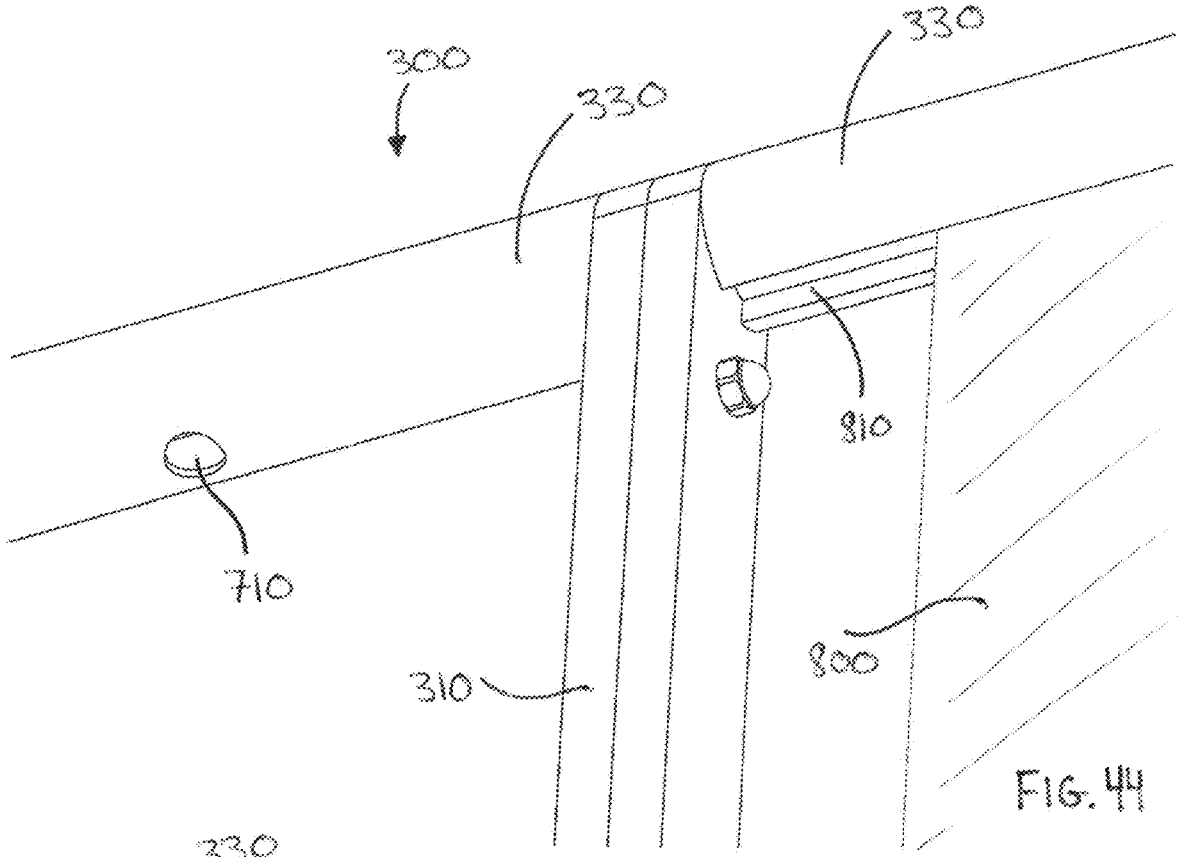
FIGS. 44 and 45 are perspective views of upper and lower portions, respectively, of the hand railing assembly illustrating attachment apertures for the spindles.
Figure 45:
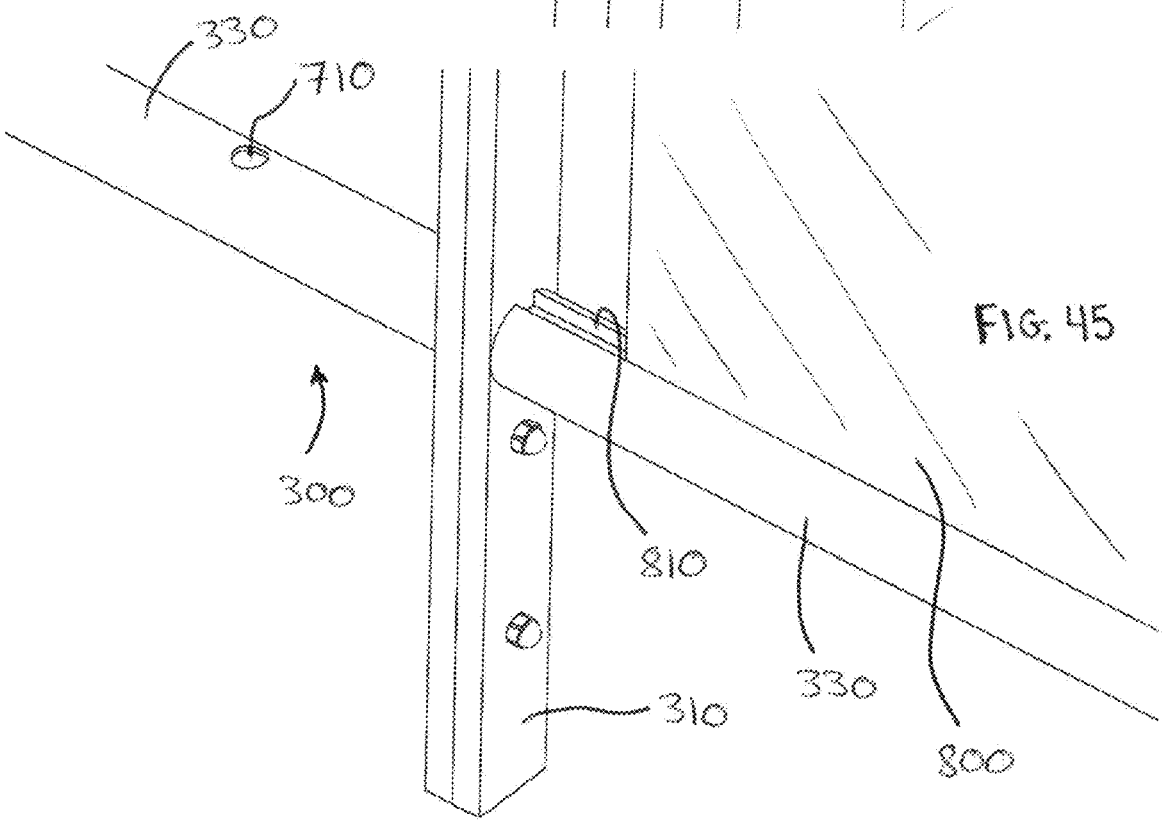
Figure 46:
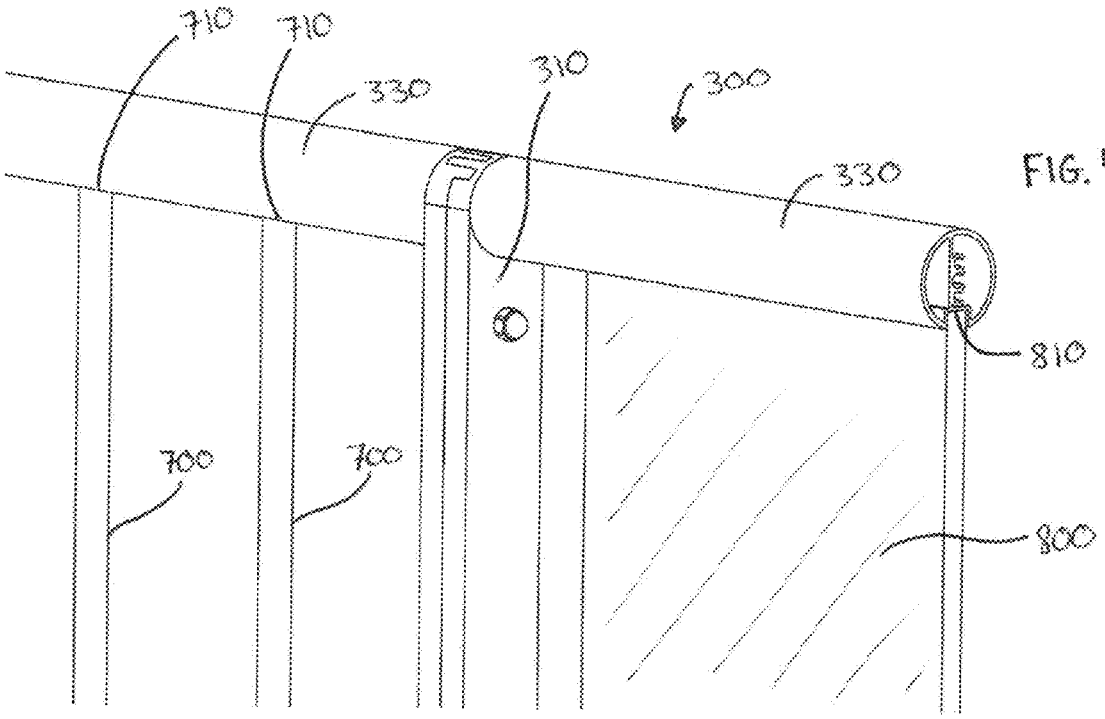
FIGS. 46 and 47 are perspective views of upper and lower portions, respectively, of the hand railing assembly illustrating attachment channels for the obstruction panels.
Figure 47:
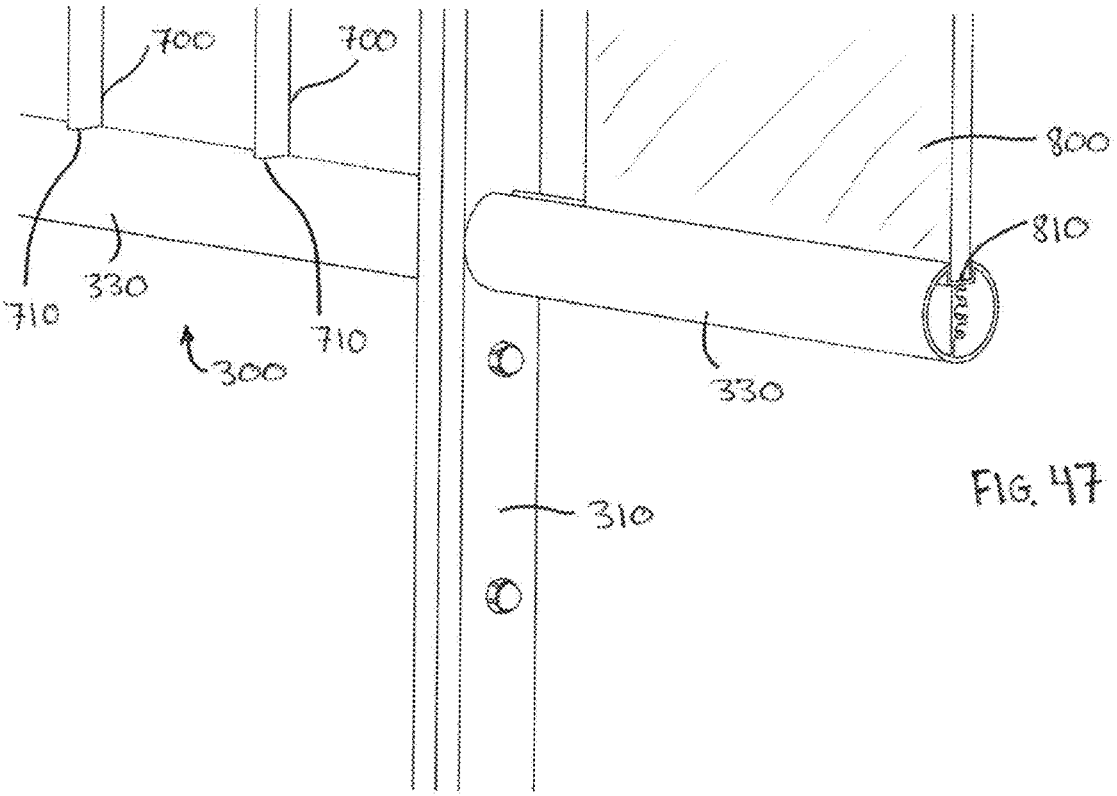

With reference to FIGS. 41 and 42, pivoting connectors 390 are illustrated. Each pivoting connector 390 includes first and second tube segments 392, 394 interconnected by a pivot joint 396. One or more screw shanks "SSS" extends from each of the first and second tube segments 392, 394 to enable attachment of the pivoting connector 390 to an intermediate rail 330 or other rail component at either end thereof, e.g., via engagement of each screw shank "SSS" within one of the c-shaped channels 342, 344, 346 of the web 336 of the intermediate rail 330 or other rail component. Pivoting connectors 390 enable of the components on either side thereof after-assembly, to achieve a desired configuration.

Turning to FIGS. 43-47, any of the rail components such as, for example, intermediate rails 330 may include attachment features to enable attachment of, e.g., spindles 700 or obstruction panels 800. More specifically, spaced-apart aperture 710 may be defined within upper and lower intermediate rails 330 to enable receipt of a plurality of spaced-apart spindles 700 therebetween. Additionally or alternatively, channels 810 recessed into the exterior surface of outer tubes 332 (formed therein during extrusion of the intermediate rails) of upper and lower intermediate rails 330 may be provided for receipt of an obstruction panel 800, e.g., a sheet of glass, metal, plywood, metal, plastic, etc.

Figure 48:
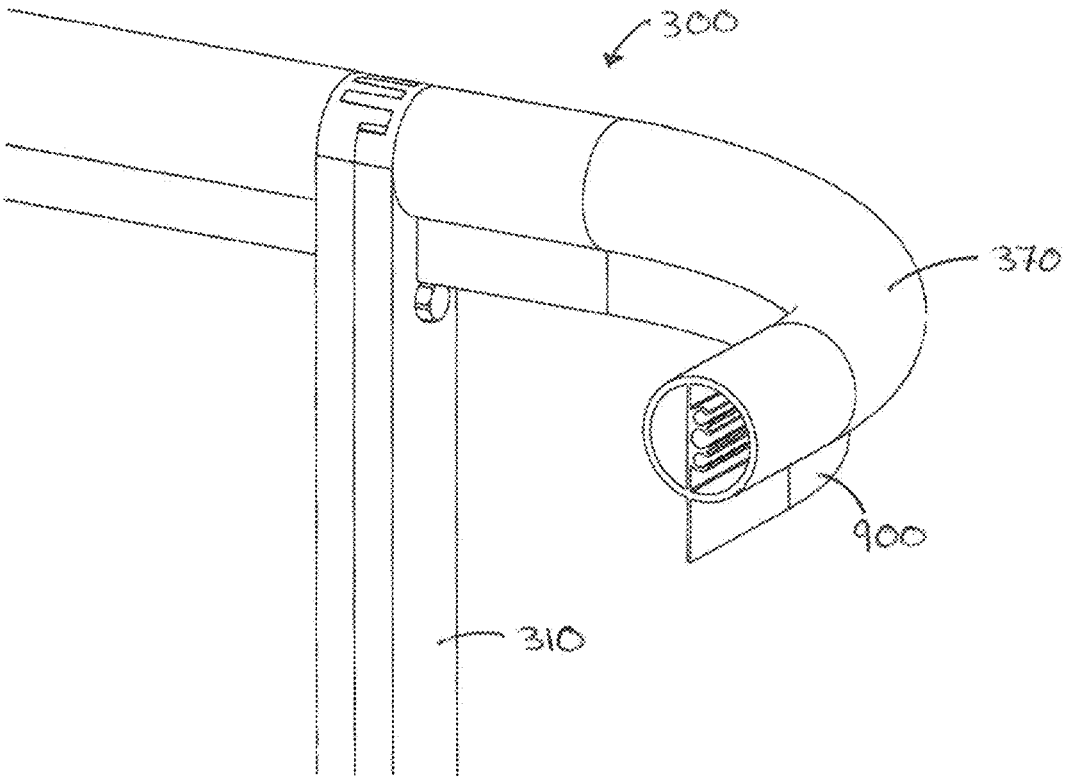
FIG. 48 is a perspective view of another portion of the hand railing assembly including a projection surface extending therefrom.

As illustrated in FIG. 48, any of the rail components such as, for example, intermediate rails 330, end rails 350, and curved connector rails 370 (as illustrated) may include features such as a projection surface 900 for example a rib, web or fin, extending therefrom, which may also be formed during extrusion, may be attached to the curved connector rail 370 in any suitable manner, or may be otherwise formed. The projection surface 900 may be disposed on the neutral plane of intermediate rails 330, end rails 350, and curved connector rail 370, providing a similar benefit when it comes to bending the rail component, as detailed above. Rail components which include such a projection 900 enable spindles 700 and/or obstructions 800 to be attached directly to the projection 900. Although, rail components which include such a projection 900 may also include features, such as apertures and/or channels, to enable spindles 700 and/or obstructions 800 to be attached in the manner detailed above.

From the foregoing and with reference to the various drawing figures, those skilled in the art will appreciate that certain modifications can also be made to the present disclosure without departing from the scope of the same. While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A modular system, comprising:

a post; and first and second rail segments, wherein each of the first and second rail segments is a monolithic extrusion including:

a tube defining a substantially hollow interior with an internal surface and an external surface; and a web connected to the internal surfaces of the tube and extending across the hollow interior thereof in offset relation relative to a center of the tube, the web including at least one screw boss configured for receipt of a fastener to enable engagement of the rail segment with the post.

2. The modular system according to claim 1, wherein the at least one screw boss is remote from the internal surface of the tube.

3. The modular system according to claim 1, wherein an axis of the at least one screw boss is disposed on a centerline of the tube.

4. The modular system according to claim 1, wherein at least one of the first or second rail segments is bent.

5. The modular system according to claim 1, wherein the tube of at least one of the first or second rail segments defines a plurality of spaced-apart apertures configured for engagement of spindles therein.

6. The modular system according to claim 1, wherein the tube of at least one of the first or second rail segments includes a channel configured for engagement of an obstruction panel therein.

7. The modular system according to claim 1, wherein at least one of the first or second rail segments includes a fin connected to the external surface of the tube and disposed on a neutral plane of the tube.

8. The modular system according to claim 1, wherein the web is disposed along a neutral plane of the tube.

9. The modular system according to claim 8, wherein at least one of the first or second rail segments is bent to define a bend axis that is substantially parallel to the neutral plane.

10. A modular system, comprising:

a post; and first and second rail segments, each of the first and second rail segments including:

a tube defining a substantially hollow interior with an internal surface and an external surface; and a web connected to the internal surfaces of the tube and extending across the hollow interior thereof, the web including at least one screw boss configured for receipt of a fastener to enable engagement of the rail segment with the post, wherein the post comprises:

a first post component defining a first outwardly-facing side and a first inwardly-facing side including a first plurality of spaced-apart ribs; and a second post component defining a second outwardly-facing side and a second inwardly-facing side including a second plurality of spaced-apart ribs, wherein the first post component is configured to engage the first rail segment with the first outwardly facing side abutting an end of the first rail segment, wherein the second post component is configured to engage the second rail segment with the second outwardly facing side abutting an end of the second rail segment, and wherein the first and second pluralities of spaced-apart ribs are configured to engage one another in inter-fit relation to engage the first and second post components with one another.

11. The modular system according to claim 10, further comprising third and fourth rail segments extending in generally parallel orientation relative to the first and second rail segments, wherein the first and second post components are configured to engage the third and fourth rail segments via fasteners extending through apertures defined within the respective first and second post components and into engagement within screw bosses of the third and fourth rail segments.

12. The modular system according to claim 10, wherein the first and second post components are substantially identical to one another.

13. The modular system according to claim 10, wherein the first and second post components are identical to one another.

14. The modular system according to claim 10, wherein each of the first and second post components is a monolithic extrusion.

15. The modular system according to claim 10, wherein the first and second post components are configured to engage the first and second rail segments via fasteners extending through apertures defined within the respective first and second post components and into engagement within the screw bosses of the first and second rail segments.

16. The modular system according to claim 15, wherein the fasteners are hidden from view when the first and second post components are engaged with the first and second rail segments and with one another.

17. The modular system according to claim 10, wherein at least one rib of the first plurality of spaced-apart ribs of the first post component defines a pocket disposed between the first outwardly-facing side and the first inwardly-facing side.

18. The modular system according to claim 17, wherein at least one rib of the second plurality of spaced-apart ribs of the second post component defines a pocket disposed between the second outwardly-facing side and the second inwardly-facing side.

19. The modular system according to claim 10, wherein at least one rib of the first plurality of spaced-apart ribs includes an engagement feature and wherein at least one rib of the second plurality of spaced-apart ribs includes a complementary engagement feature, the engagement feature and the complementary engagement feature configured to engage one another to secure the first and second post components with one another with the first and second pluralities of spaced-apart ribs engaged with one another in inter-fit relation.

20. The modular system according to claim 10, further comprising a fastener configured to secure the first and second post components with one another with the first and second pluralities of spaced-apart ribs engaged with one another in inter-fit relation.

21. The modular system according to claim 20, wherein the engagement feature and the complementary engagement feature are configured for snap-fit engagement with one another.

* * * * *